US012747880B2

(12) United States Patent
Chai et al.

(10) Patent No.: US 12,747,880 B2
(45) Date of Patent: Sep. 29, 2026

(54) AIR CONDITIONER, CONTROL SYSTEM AND CONTROL METHOD OF AIR CONDITIONER

(71) Applicant: QINGDAO HISENSE HITACHI AIR-CONDITIONING SYSTEMS CO., LTD., Qingdao (CN)

(72) Inventors: Fanggang Chai, Qingdao (CN); Tiejun Sun, Qingdao (CN); Qian Qiu, Qingdao (CN); Yulei Zhao, Qingdao (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 121 days.

(21) Appl. No.: 18/652,486

(22) Filed: May 1, 2024

(65) Prior Publication Data

US 2024/0288188 A1 Aug. 29, 2024

Related U.S. Application Data

(63) Continuation of application No. PCT/CN2022/136317, filed on Dec. 2, 2022.

(30) Foreign Application Priority Data

Mar. 30, 2022 (CN) ..... 202220716072.6
Mar. 30, 2022 (CN) ..... 202220725436.7
(Continued)

(51) Int. Cl.
*F24F 8/30* (2021.01)

(52) U.S. Cl.
CPC ..... *F24F 8/30* (2021.01)

(58) Field of Classification Search
CPC ..... F24F 8/30; F24F 1/00
See application file for complete search history.

(56) References Cited

U.S. PATENT DOCUMENTS

2021/0143722 A1 5/2021 Ieta

FOREIGN PATENT DOCUMENTS

CN 105862973 A 8/2016
CN 107894028 A 4/2018
(Continued)

OTHER PUBLICATIONS

International Search Report and Written Opinion dated Sep. 28, 2022 in corresponding International Application No. PCT/CN2022/103055, translated, 21 pages.
(Continued)

*Primary Examiner* — Lionel Nouketcha
(74) *Attorney, Agent, or Firm* — MH2 Technology Law Group LLP

(57) ABSTRACT

An air conditioner includes an indoor unit. The indoor unit includes a first housing, a fan, a piping box, and a nano water ion generating device. The first housing includes a first accommodating space, a return air inlet, and an air outlet. The fan is opposite to the return air inlet. The piping box is disposed in the first accommodating space and proximate to the air outlet. The nano water ion generating device is located at a position of the first housing proximate to the air outlet. The nano water ion generating device includes a nano water ion outlet. The nano water ion generating device and the piping box are communicatd through a vent therebetween. Air in the piping box enters the nano water ion generating device through the vent, and air with the nano water ions is sent indoors through the nano water ion outlet.

19 Claims, 11 Drawing Sheets

(30) Foreign Application Priority Data

Mar. 31, 2022 (CN) ..... 202220731725.8
Mar. 31, 2022 (CN) ..... 202220733579.2

(56) References Cited

FOREIGN PATENT DOCUMENTS

| | | | | |
|---|---|---|---|---|
| CN | 210296870 | U | | 4/2020 |
| CN | 113432217 | A | | 9/2021 |
| CN | 113531699 | A | | 10/2021 |
| CN | 214536497 | U | | 10/2021 |
| CN | 113719906 | A | | 11/2021 |
| CN | 114172026 | A | | 3/2022 |
| CN | 215929865 | U | | 3/2022 |
| CN | 114279039 | A | | 4/2022 |
| CN | 114383248 | A | | 4/2022 |
| CN | 114396697 | A | | 4/2022 |
| CN | 216346688 | U | | 4/2022 |
| CN | 217004689 | U | | 7/2022 |
| CN | 217082726 | U | | 7/2022 |
| CN | 217082727 | U | | 7/2022 |
| CN | 114893828 | A | | 8/2022 |
| EP | 2336665 | A1 | | 6/2011 |
| EP | 2404621 | A1 | | 1/2012 |
| JP | 2002095732 | A | * | 4/2002 |
| JP | 2016223706 | A | * | 12/2016 |
| WO | 2010029716 | A1 | | 3/2010 |

OTHER PUBLICATIONS

International Search Report and Written Opinion dated Sep. 28, 2022 in corresponding International Application No. PCT/CN2022/103067, translated, 19 pages.

International Search Report and Written Opinion dated Jan. 19, 2023 in corresponding International Application No. PCT/CN2022/136313, translated, 16 pages.

International Search Report and Written Opinion dated Feb. 10, 2023 in corresponding International Application No. PCT/CN2022/136317, translated, 17 pages.

Chinese First Office Action dated Apr. 26, 2023 in corresponding Chinese Application No. 202210324187.5, translated, 16 pages.

* cited by examiner

AIR CONDITIONER, CONTROL SYSTEM AND CONTROL METHOD OF AIR CONDITIONER

CROSS-REFERENCE TO RELATED APPLICATIONS

This application is a continuation application of International Patent Application No. PCT/CN2022/136317, filed on Dec. 2, 2022, which claims priority to Chinese Patent Application No. 202220725436.7, filed on Mar. 30, 2022; Chinese Patent Application No. 202220716072.6, filed on Mar. 30, 2022; Chinese Patent Application No. 202220733579.2, filed on Mar. 31, 2022; and Chinese Patent Application No. 202220731725.8, filed on Mar. 31, 2022, which are incorporated herein by reference in their entireties.

TECHNICAL FIELD

The present disclosure relates to the field of air conditioning technologies, and in particular, to an air conditioner, a control system, and a control method for an air conditioner.

BACKGROUND

With an advancement of science and technology and an improvement of people's living standards, air conditioners have gradually entered people's life and become an indispensable product in people's work and life.

A split-type air conditioner includes an indoor unit and an outdoor unit. The indoor unit and the outdoor unit are installed indoors and outdoors, respectively, and are connected through pipelines and wires. In general, in order to improve indoor air quality, the air conditioners further have air purification functions.

SUMMARY

In an aspect, an air conditioner is provided. The air conditioner includes an outdoor unit and an indoor unit. The indoor unit is connected to the outdoor unit. The indoor unit includes a first housing, a fan, an indoor heat exchanger, a piping box, and a nano water ion generating device. The first housing includes a first accommodating space, a return air inlet, and an air outlet. The return air inlet and the air outlet are communicated with the first accommodating space. The fan is disposed in the first accommodating space and is opposite to the return air inlet. The indoor heat exchanger is disposed in the first accommodating space and located at a side of the fan proximate to the air outlet. The piping box is disposed in the first accommodating space and proximate to the air outlet. The nano water ion generating device is disposed in the first accommodating space and located at a position of the first housing proximate to the air outlet. The nano water ion generating device is configured to generate nano water ions with negative charges and hydroxyl radicals generated by ionized water. The nano water ion generating device includes a nano water ion outlet. The nano water ion generating device and the piping box are communicatd through a vent therebetween. Air in the piping box enters the nano water ion generating device through the vent, and air with the nano water ions is sent indoors through the nano water ion outlet, so as to avoid influence of temperature and humidity changes in air at the air outlet on condensation ability of the nano water ion generating device.

In another aspect, a control system of an air conditioner is provided. The air conditioner includes an outdoor unit and an indoor unit. The indoor unit includes an indoor controller, a fan, and a nano water ion generating device. The control system includes a microcontroller, a fan controller, and a purification device controller. The microcontroller is disposed on the indoor controller. The fan controller is disposed on the indoor controller and electrically connected to the microcontroller. The fan is electrically connected to the fan controller. The purification device controller is disposed on the indoor controller and electrically connected to the microcontroller. The nano water ion generating device is disposed at the air outlet of the indoor unit and electrically connected to the purification device controller. The nano water ion generating device is controlled by the indoor controller of the indoor unit and is linked with the fan of the indoor unit.

In yet another aspect, a control method of an air conditioner is provided. The air conditioner includes an outdoor unit and an indoor unit. The indoor unit includes a fan and a nano water ion generating device. The method includes that in a case where the purification function is turned on, determining whether the fan is turned on and determining a turn-on time; in a case where a first time that the fan is turned on is greater than the first threshold, the nano water ion generating device is turned on, otherwise the nano water ion generating device is not capable of being turned on; in a case where the purification function is turned off, the nano water ion generating device immediately cuts off power and keeps the fan operating for a second time; and in a case where the second time is greater than the second threshold, the fan is controlled to be turned off.

DETAILED DESCRIPTION

Figure 1A:
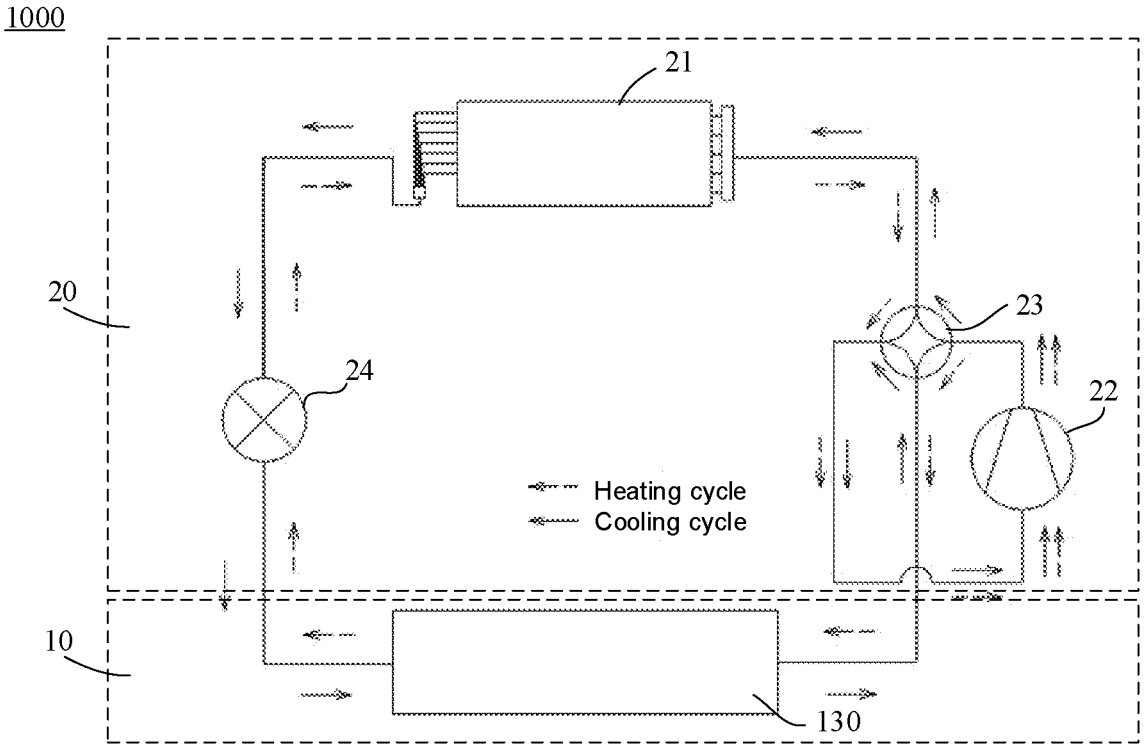
FIG. 1A is a schematic diagram of an air conditioner, in accordance with some embodiments.

The technical solutions in some embodiments of the present disclosure will be described clearly and completely with reference to the accompanying drawings; obviously, the described embodiments are merely some, but not all of, embodiments of the present disclosure. All other embodiments obtained by a person of ordinary skill in the art based on embodiments of the present disclosure shall be included in the protection scope of the present disclosure.

Unless the context requires otherwise, throughout the specification and the claims, the term "comprise" and other forms thereof such as the third-person singular form "comprises" and the present participle form "comprising" are construed as an open and inclusive meaning, i.e., "including, but not limited to." In the description of the specification, the terms such as "one embodiment," "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

The terms "first" and "second" are used for descriptive purposes only and are not to be construed as indicating or implying a relative importance or implicitly indicating a number of indicated technical features. Thus, features defined by "first" or "second" may explicitly or implicitly include one or more of the features. In the description of the embodiments of the present disclosure, the term "a plurality of" or "the plurality of" means two or more unless otherwise specified.

In the description of some embodiments, the expressions "coupled," "connected," and derivatives thereof may be used. The term "connected" should be understood in a broad sense. For example, the term "connected" may represent a fixed connection, a detachable connection, or a one-piece connection, or may represent a direct connection, or may represent an indirect connection through an intermediate medium. The term "coupled" may be used in the description of some embodiments to indicate that two or more components are in direct physical or electrical contact with each other. However, the term "coupled" or "communicatively coupled" may also mean that two or more elements are not in direct contact with each other but still cooperate or interact with each other. The embodiments disclosed herein are not necessarily limited to the contents herein.

The phrase "at least one of A, B, and C" has the same meaning as the phrase "at least one of A, B, or C", both including the following combinations of A, B, and C: only A, only B, only C, a combination of A and B, a combination of A and C, a combination of B and C, and a combination of A, B, and C.

The phrase "A and/or B" includes the following three combinations: only A, only B, and a combination of A and B.

As used herein, the term "if" is, optionally, construed as "when" or "in a case where" or "in response to determining that" or "in response to detecting," depending on the context. Similarly, depending on the context, the phrase "if it is determined that" or "if [a stated condition or event] is detected" is optionally construed as "in a case where it is determined that" or "in response to determining that" or "in a case where [the stated condition or event] is detected" or "in response to detecting [the stated condition or event]."

The use of the phrase "applicable to" or "configured to" herein means an open and inclusive expression, which does not exclude devices that are applicable to or configured to perform additional tasks or steps.

Additionally, the use of the phase "based on" is meant to be open and inclusive, since a process, step, calculation, or other action that is "based on" one or more of the stated conditions or values may, in practice, be based on additional conditions or value beyond those stated.

The term such as "about," "substantially," or "approximately" as used herein includes a stated value and an average value within an acceptable range of deviation of a particular value determined by a person of ordinary skill in the art, considering measurement in question and errors associated with measurement of a particular quantity (i.e., limitations of a measurement system).

The term such as "parallel," "perpendicular," or "equal" as used herein includes a stated condition and a condition similar to the stated condition. A range of the similar condition is within an acceptable deviation range, and the acceptable deviation range is determined by a person of ordinary skill in the art, considering measurement in question and errors associated with measurement of a particular quantity (i.e., the limitations of a measurement system). For example, the term "parallel" includes absolute parallelism and approximate parallelism, and an acceptable range of deviation of the approximate parallelism may be, for example, a deviation within 5°; the term "perpendicular" includes absolute perpendicularity and approximate perpendicularity, and an acceptable range of deviation of the approximate perpendicularity may also be, for example, a deviation within 5°. The term "equal" includes absolute equality and approximate equality, and an acceptable range of deviation of the approximate equality may be, for example, a difference between two equals of less than or equal to 5% of either of the two equals.

[Basic Operating Principles of an Air Conditioner]

In some embodiments of the present disclosure, an air conditioner is provided. As shown in FIG. 1A, the air conditioner 1000 includes an indoor unit 10 and an outdoor unit 20. The indoor unit 10 and the outdoor unit 20 are connected by a pipe to transport a refrigerant.

The indoor unit 10 includes an indoor heat exchanger 130. The outdoor unit 20 includes an outdoor heat exchanger 21, a compressor 22, a four-way valve 23, and a throttle mechanism 24. In some embodiments, the throttle mechanism 24 may further be provided in the indoor unit 10. The throttle mechanism 24 may be composed of at least one of a throttle valve, an expansion valve, a pressure reducer, and the like. For example, the throttle mechanism 24 may be composed of an expansion valve only, or may be composed of an expansion valve and a throttle valve connected in series, or may be composed of an expansion valve and a pressure reducer connected in series, and the present disclosure is not limited thereto.

The compressor 22, the outdoor heat exchanger 21, the throttle mechanism 24 and the indoor heat exchanger 130 are connected in sequence to form a refrigerant loop. The refrigerant circulates in the refrigerant loop and exchanges heat with air through the outdoor heat exchanger 21 and the indoor heat exchanger 130, so as to implement the cooling or heating of the air conditioner 1000.

The compressor 22 is configured to compress the refrigerant, so that low-temperature and low-pressure refrigerant is compressed to form high-temperature and high-pressure refrigerant.

The outdoor heat exchanger 21 is configured to perform heat-exchange between outdoor air and the refrigerant conveyed in the outdoor heat exchanger 21. For example, the outdoor heat exchanger 21 operates as a condenser in a cooling mode of the air conditioner 1000, so that the refrigerant compressed by the compressor 22 passes through the outdoor heat exchanger 21 to dissipate heat into the outdoor air to be condensed. The outdoor heat exchanger 21 operates as an evaporator in a heating mode of the air conditioner 1000, so that the decompressed refrigerant passes through the outdoor heat exchanger 21 to absorb heat in the outdoor air to be evaporated.

Generally, the outdoor heat exchanger 21 further includes heat exchange fins to enlarge a contact area between the outdoor air and the refrigerant transported in the outdoor heat exchanger 21, thereby improving heat exchange efficiency between the outdoor air and the refrigerant.

The throttle mechanism 24 is connected between the outdoor heat exchanger 21 and the indoor heat exchanger 130. A pressure of a refrigerant flowing between the outdoor heat exchanger 21 and the indoor heat exchanger 130 is adjusted by an opening degree of the throttle mechanism 24, so as to adjust the flow of the refrigerant flowing between the outdoor heat exchanger 21 and the indoor heat exchanger 130. The flow and pressure of the refrigerant flowing between the outdoor heat exchanger 21 and the indoor heat exchanger 130 will affect the heat exchange performance of the outdoor heat exchanger 21 and the indoor heat exchanger 130. The throttle mechanism 24 may be an electronic valve. The opening degree of the throttle mechanism 24 is adjustable, so as to control the flow and pressure of the refrigerant flowing through the throttle mechanism 24. In a case where the air conditioner 1000 operates in the cooling mode, the throttle mechanism 24 is configured to throttle a supercooled liquid refrigerant flowing out of the outdoor heat exchanger 21 into a gas-liquid two-phase refrigerant with low temperature and low pressure, and the flow direction of the refrigerant is shown by solid arrows in FIG. 1A. In a case where the air conditioner 1000 operates in the heating mode, the throttle mechanism 24 is configured to throttle the supercooled liquid refrigerant flowing out of the indoor heat exchanger 130 into the gas-liquid two-phase refrigerant with low temperature and low pressure, and the flow direction of the refrigerant is shown by dashed arrows in FIG. 1A.

The four-way valve 23 is connected in the refrigerant loop and is configured to switch a flow direction of the refrigerant in the refrigerant loop, so as to cause the air conditioner 1000 to perform the cooling mode or the heating mode.

The indoor heat exchanger 130 is configured to perform heat-exchange between indoor air and the refrigerant conveyed in the indoor heat exchanger 130. For example, the indoor heat exchanger 130 operates as an evaporator in a cooling mode of the air conditioner 1000, so that the refrigerant that has been heat-dissipated via the outdoor heat exchanger 21 passes through the indoor heat exchanger 130 to absorb heat in the indoor air to be evaporated. The indoor heat exchanger 130 operates as a condenser in a heating mode of the air conditioner 1000, so that the refrigerant that has absorbed heat via the outdoor heat exchanger 21 passes through the indoor heat exchanger 130 to dissipate heat into the indoor air to be condensed.

Generally, the indoor heat exchanger 130 further includes heat exchange fins to enlarge a contact area between the indoor air and the refrigerant transported in the indoor heat exchanger 130, thereby improving heat exchange efficiency between the indoor air and the refrigerant.

Operation manners of the cooling mode and the heating mode of the air conditioner 1000 will be described below with reference to FIG. 1A.

As shown in FIG. 1A, in a case where the air conditioner 1000 operates in the cooling mode, the refrigerant is compressed by the compressor 22 to become a superheated gaseous refrigerant with high-temperature and high-pressure, and the superheated gaseous refrigerant is discharged into the outdoor heat exchanger 21 for condensation. In the outdoor heat exchanger 21, the superheated gaseous refrigerant is cooled into a supercooled liquid refrigerant, and the supercooled liquid refrigerant flows into the throttle mechanism 24. The throttle mechanism 24 may throttle the supercooled liquid refrigerant into the gas-liquid two-phase refrigerant with low temperature and low pressure. The gas-liquid two-phase refrigerant with low temperature and low pressure flows into the indoor heat exchanger 130 to evaporate and absorb heat. In the indoor heat exchanger 130, the refrigerant is evaporated into superheated gas again and returned to a suction end of the compressor 22 to accomplish a cycle. As shown in FIG. 1A, in a case where the air conditioner 1000 operates in the heating mode, a gaseous refrigerant with high temperature and high pressure flows through the four-way valve 23 and is directly discharged into the indoor heat exchanger 130 for heating. After being cooled into a supercooled liquid phase in the indoor heat exchanger 130, the supercooled liquid refrigerant flows into the throttle mechanism 24 and is throttled by the throttle mechanism 24 into the gas-liquid two-phase refrigerant with low temperature and low pressure. The gas-liquid two-phase refrigerant with low temperature and low pressure flows into the outdoor heat exchanger 21 for heat absorption and evaporation.

Some indoor units with air purification functions in the related art utilize nano water ions as to perform air purification. On the one hand, a main purification factor of the nano water ion device is hydroxyl free radicals. The sterilization effect of the hydroxyl free radicals is good, but the particle purification effect is poor. On the other hand, the overall nano water ion device needs to be installed inside the indoor unit, and a nano water ion outlet is connected to an air outlet of the indoor unit through a pipe. However, the device itself has no power system and only relies on the trace negative pressure generated by the air flow at an air outlet of the indoor unit, so as to suck the nano water ions from the nano water ion (i.e., nanoe) device to the air outlet of the indoor unit. In a case where the nano water ions generated by this structure are transmitted from the nanoe device to the air outlet of the indoor unit, the hydroxyl radicals, due to the instability, have been decomposed during the transmission process and have not yet reached the indoor air to purify the indoor air.

Nano water ion technology refers to nano-scale electrostatic atomization water particles. The technology performs high voltage discharge on the water droplets on the tip electrode, causing them to gradually split into water mist and decompose into highly active nano-scale water ions, which contain a large number of highly active hydroxyl free radicals. The hydroxyl free radicals have extremely high oxidizing properties and may decompose and remove bacteria, microorganisms, formaldehyde, volatile organic compounds (VOC), and other components in the air.

Water will be gradually consumed during the generation of the nano water ions. The nano water ion technology in the related technology uses a semiconductor refrigeration technology and utilizes a semiconductor cooling portion to cool the transmission electrode. The transmission electrode is hydrophilic, and the transmission electrode may absorb moisture from the surrounding air after being cooled. Then, the transmission electrode utilizes negative high voltage to generate tip discharge at the transmission tip of the transmission electrode to generate the nano water ions. This water supply method that uses the transmission electrode to cool down to generate condensed water has a problem that the transmission electrode is difficult to generate condensed water in a case where the air humidity is low. In this case, the nano water ions may not be generated. Moreover, due to the influence of the semiconductor cooling, the emitter electrode serves as a grounding electrode for emission, and the counter electrode uses the positive high voltage. Therefore, the generated nano water ions do not contain negative ions and lack the functional effect of negative ions.

In view of this, some embodiments of the present disclosure provide an air conditioner. The nano water ion generating device is located at an air outlet and may diffuse the generated nano water ions into indoors in a direction of the air flow from the air outlet, so as to achieve a purpose of sterilizing and disinfecting the air.

Figure 1B:
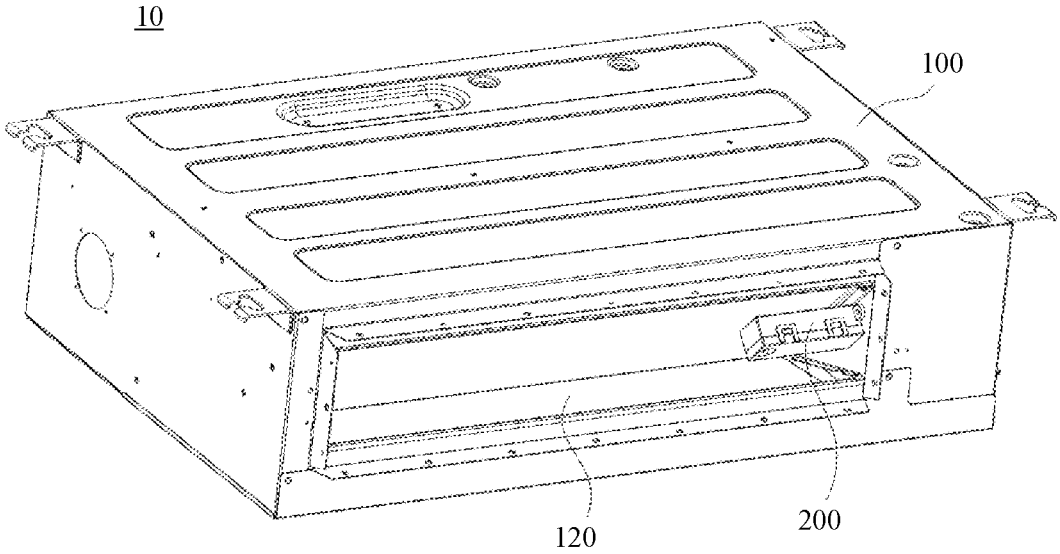
FIG. 1B is a structural diagram of an indoor unit, in accordance with some embodiments.
Figure 2:
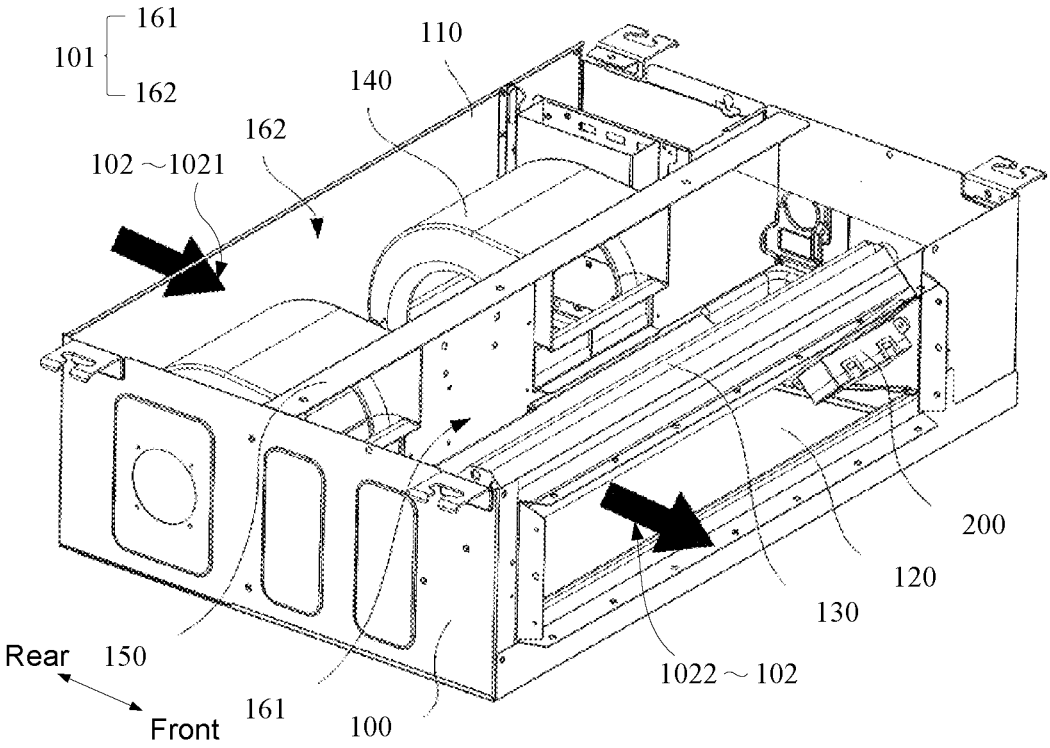
FIG. 2 is a structural diagram of an indoor unit without a top cover plate, in accordance with some embodiments.

Referring to FIGS. 1B and 2, the indoor unit 10 of the air conditioner 1000 further includes a nano water ion generating device 200. The nano water ion generating device 200 may generate nano water ions with negative ions, thereby implementing the air purification function of the air conditioner 1000.

In some embodiments, the air conditioner 1000 includes a nano water ion generating device 200. Alternatively, the air conditioner 1000 may also include a plurality of nano water ion generating devices 200 used in parallel, which is conducive to improving the production of negative ions and nano water ions, thereby further improving the air purification effect.

[Indoor Unit]

Some embodiments of the present disclosure provide an indoor unit 10. Referring to FIGS. 1B to 3, the indoor unit 10 includes a first housing 100 (i.e., an indoor unit housing), a fan 140, an indoor heat exchanger 130, a piping box 170, and a nano water ion generating device 200.

The first housing 100 includes a first accommodating space 101, a return air inlet 110, and an air outlet 120. The return air inlet 110 and the air outlet 120 are respectively communicated with the first accommodating space 101. The fan 140 is installed in the first accommodating space 101 and is opposite to the return air inlet 110.

The indoor heat exchanger 130 is installed at a side of the fan 140 proximate to the air outlet 120. The piping box 170 is installed in the first accommodating space 101 and is disposed proximate to the air outlet 120. The nano water ion generating device 200 is installed at a position of the first housing 100 proximate to the air outlet 120.

Figure 4:
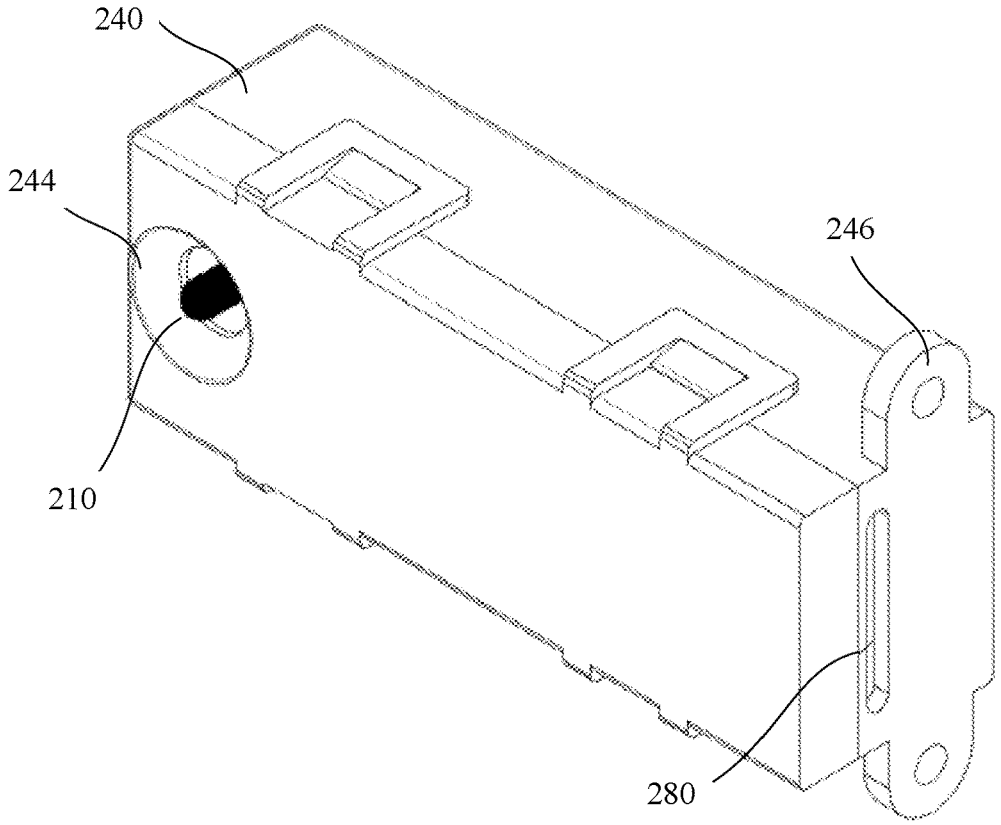
FIG. 4 is a structural diagram of a nano water ion generating device, in accordance with some embodiments.
Figure 5:
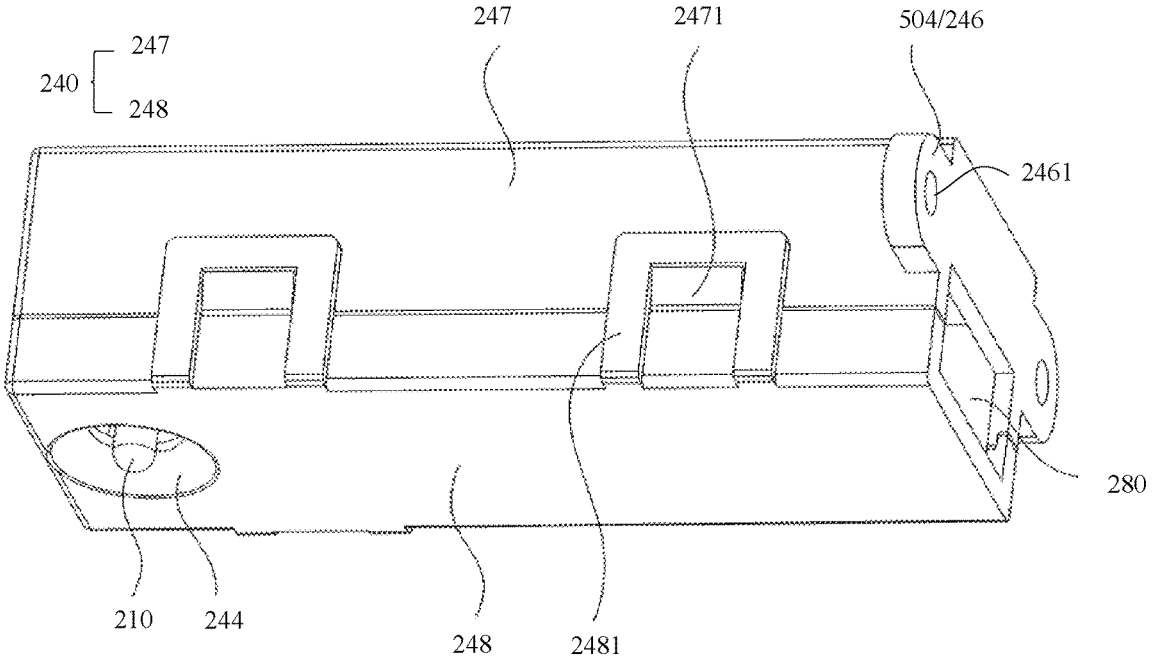
FIG. 5 is another structural diagram of a nano water ion generating device, in accordance with some embodiments.
Figure 6:
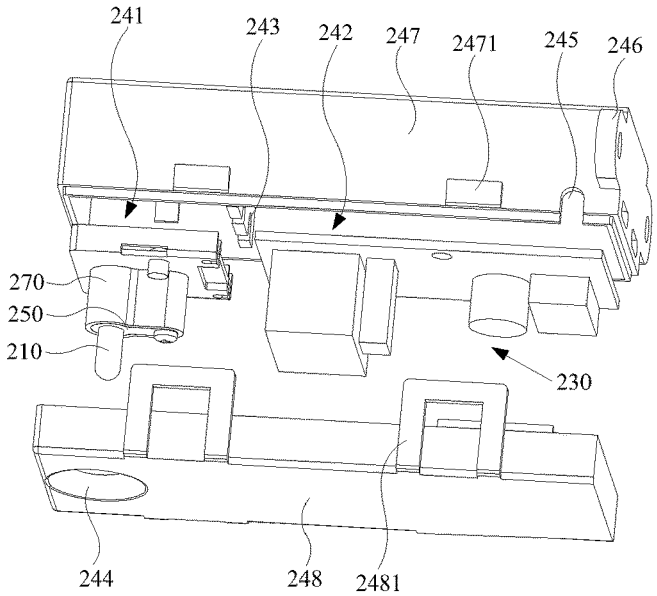
FIG. 6 is an exploded view of an nano water ion generating device in FIG. 5.

Referring to FIGS. 4 to 6, the nano water ion generating device 200 includes a transmission electrode 210 and a nano water ion outlet 244. The nano water ion generating device 200 and the piping box 170 are connected through a vent therebetween.

The air in the piping box 170 enters the nano water ion generating device 200 through the vent, and the air containing nano water ions are sent to the indoors through the nano water ion outlet 244. The piping box 170 is used to install a water suction pump, water pipes, float switches, etc.

An outer contour of the indoor unit 10 is formed by the first housing 100. Referring to FIGS. 1B to 3, a side of the first housing 100 is provided with the return air inlet 110, and another side of the first housing 100 is provided with the air outlet 120. The return air inlet 110 and the air outlet 120 are communicated to form an air duct 102, and the indoor heat exchanger 130 is disposed in the air duct 102.

The indoor air flows into the first accommodating space 101 through the return air inlet 110 and flows into indoors through the air outlet 120 after exchanging heat with the indoor heat exchanger 130, so as to achieve cooling or heating of the indoor air.

Figure 3:
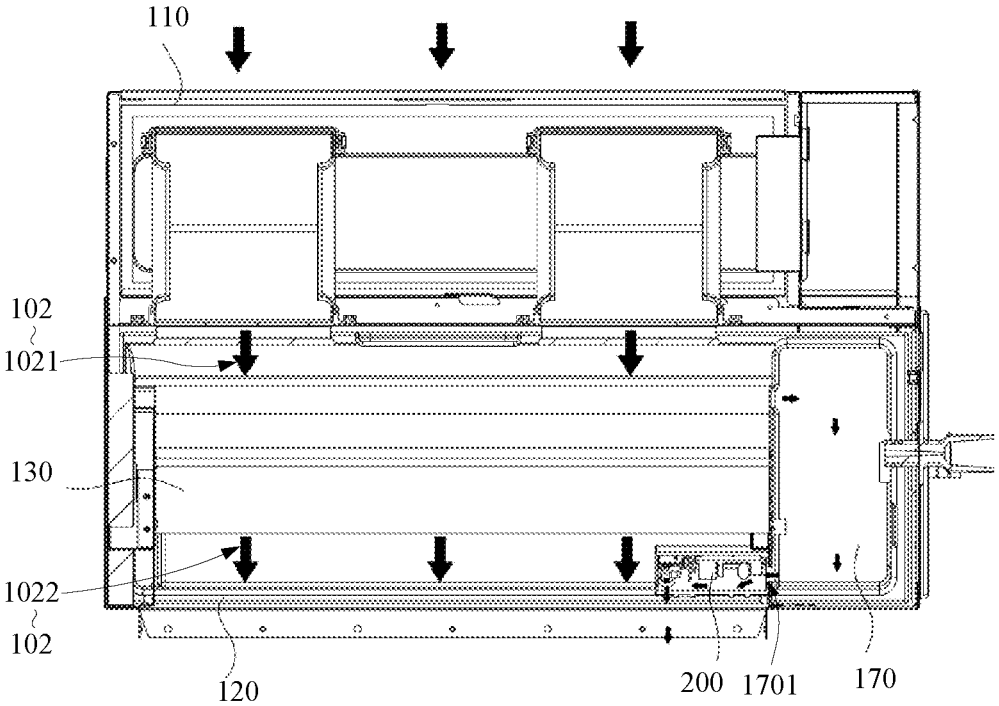
FIG. 3 is a diagram showing a flow path of gas in an indoor unit, in accordance with some embodiments.

The air flow of the indoor unit 10 is divided into two paths. Referring to FIGS. 2 and 3, one path is that the indoor air enters the first accommodating space 101 from the return air inlet 110 and passes through the indoor heat exchanger 130, the nano water ion generating device 200, and the air outlet 120 in sequence to return to the indoors. Another path is that the air in the piping box 170 enters the nano water ion generating device 200 through the vent and enters the indoors through the nano water ion outlet 244.

According to the indoor unit 10 in some embodiments of the present disclosure, the impact of changes in temperature and humidity of the air at the air outlet 120 on the water condensation ability of the nano water ion generating device 200 is effectively avoided through the separate gas channel (i.e., the other gas channel mentioned above), so that the nano water ion generating device 200 is capable of smoothly spraying the nano water ions. In this way, the air containing the nano water ions may be effectively sent indoors, and the air purification ability of the indoor unit 10 may be improved.

It will be noted that the indoor air enters the indoor unit 10 through the return air inlet 110, and the fan 140 provides power for the entire indoor unit system.

The nano water ion generating device 200 is disposed proximate to the air outlet 120. The nano water ion generating device 200 is communicated to the piping box 170. The ion wind generated by the negative oxygen water ions emitted from the nano water ion outlet 244 and the negative pressure generated by the air flow at the air outlet 120 attract the air in the piping box 170 to the nano water ion outlet 244, thereby ensuring that different temperature and humidity conditions will not affect the ability of the cooling portion 220 in the nano water ion generating device 200 to generate the condensate water. In addition, the air from the air outlet 120 will not directly blow toward the transmission electrode 210 and thus will not affect the condensation effect of the cooling portion 220 (e.g., the semiconductor cooling portion) of the transmission electrode 210 on the air.

Figure 11:
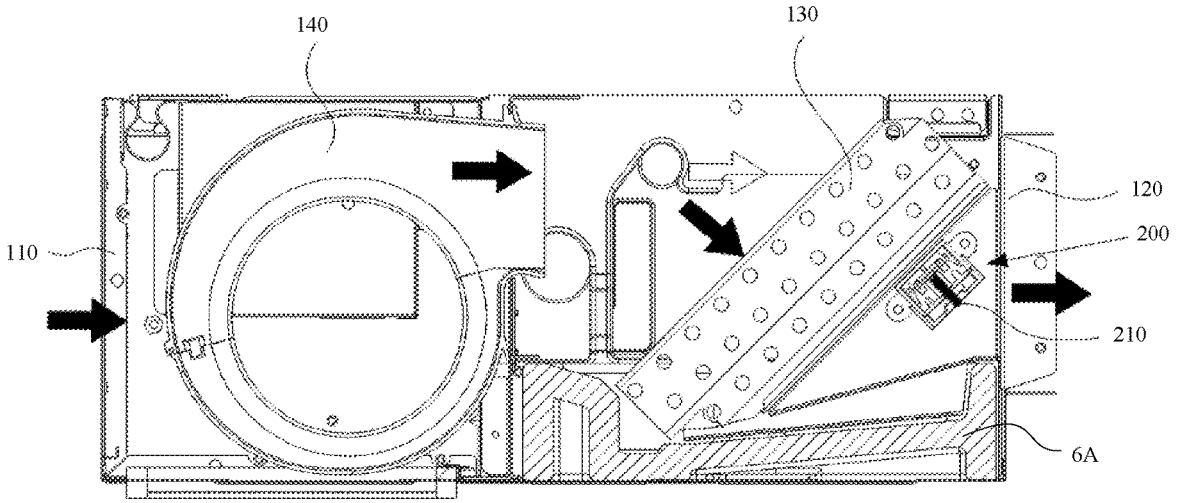
FIG. 11 is an installation diagram of a nano water ion generating device in an indoor unit, in accordance with some embodiments.

In some embodiments, referring to FIG. 11, the indoor unit 10 further includes a water pan 6A. The water pan 6A is disposed at a side of the indoor heat exchanger 130 and is configured to receive the condensate water.

Referring to FIG. 2, the indoor unit 10 includes a first partition plate 150 disposed in the first accommodating space 101, and the first partition plate 150 is configured to divide the first accommodating space 101 into a first sub-space 161 and a second sub-space 162. For example, the first sub-space 161 is a front cavity of the first accommodating space 101, and the second sub-space 162 is a rear cavity of the first accommodating space 101.

The fan 140 is located in the second sub-space 162, and the return air inlet 110 is communicated with the second sub-space 162. The indoor heat exchanger 130 is located in the first sub-space 161, and the air outlet 120 is communicated to the first sub-space 161.

In a case where the indoor unit 10 is applied to the air conditioner 1000, the air conditioner 1000 is formed with the air outlet 120 on a front panel thereof, so as to discharge the cooled or heated air into indoors. The nano water ion generating device 200 is located in the above-mentioned air outlet 120, and the nano water ions generated by ionization are diffused into indoors along the direction of the air flow from the air outlet, so as to achieve the purpose of sterilizing and disinfecting the air.

[Connecting Plate]

In some embodiments, the indoor unit 10 further includes a connecting plate 180, and the connecting plate 180 is disposed on a side wall of the first housing 100 proximate to the air outlet 120 and is configured to install the nano water ion generating device 200. For example, the connecting plate 180 is disposed in the first accommodating space 101 and connected to an end of the indoor heat exchanger 130.

Figure 7:
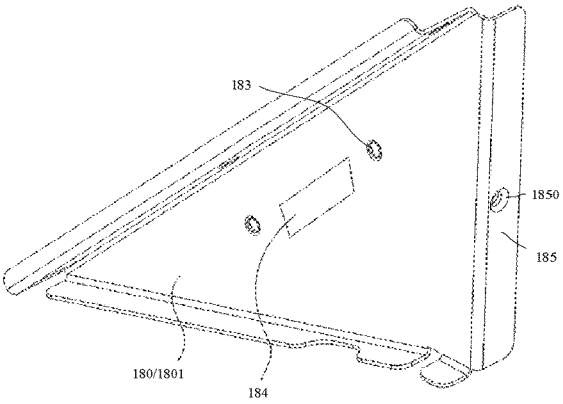
FIG. 7 is a structural diagram of a connecting plate, in accordance with some embodiments.

Referring to FIGS. 2, 5, and 7, the piping box 170 includes a first vent 1701 (see FIG. 3), the nano water ion generating device 200 includes a second vent 280, and the connecting plate 180 includes a third vent 184. The air in the piping box 170 flows through the first vent 1701, the third vent 184, and the second vent 280 and enters the nano water ion generating device 200.

It will be noted that the above-mentioned vents include the first vent 1701, the second vent 280, and the third vent 184.

In some embodiments, referring to FIG. 7, the connecting plate 180 includes a body 1801, a first fixing portion 185 (e.g., a body fixing portion), and a second fixing portion 183 (e.g., a device fixing portion).

The first fixing portion 185 is disposed around the body, and the connecting plate 180 is connected to the first housing 100 through the first fixing portion 185. The third vent 184 run through the body 1801 along a thickness direction of the body 1801, and the third vent 184 is communicated with the second vent 280. The second fixing portion 183 is disposed proximate to the third vent 184, and the second fixing portion 183 is connected to the fixed installation member 504 of the nano water ion generating device 200. In this way, the fixed connection between the nano water ion generating device 200 and the connecting plate 180 may be achieved. The fixed installation member 504 will be described below.

Here, a shape of the third vent 184 may be set according to a shape of the corresponding vent of the nano water ion generating device 200 and the piping box 170.

In some embodiments, an edge of the body 1801 is bent to form the first fixing portion 185. For example, a side edge of the body 1801 extends towards a direction proximate to the piping box 170 to form a portion of the first fixing portion 185, and remaining side edges of the body 1801 extend towards a direction proximate to the nano water ion generating device 200 to form another portion of the first fixing portion 185.

The first fixing portion 185 includes a through hole and/or an opening 1850 to assist in mounting the connecting plate 180 on the first housing 100.

The second fixing portion 183 is disposed proximate to the nano water ion generating device 200. For example, a positional relationship between the second fixing portion 183 and the third vent 184 is set according to a positional relationship between the second vent 280 of the nano water ion generating device 200 and the fixed installation member 504, so as to achieve stable installation of the nano water ion generating device 200 and ensure ventilation between the nano water ion generating device 200 and the piping box 170. For example, the second fixing portion 183 is set as mounting through holes, and the mounting through holes are disposed on both sides of the third vent 184 along a length direction of the third vent 184.

Figure 9:
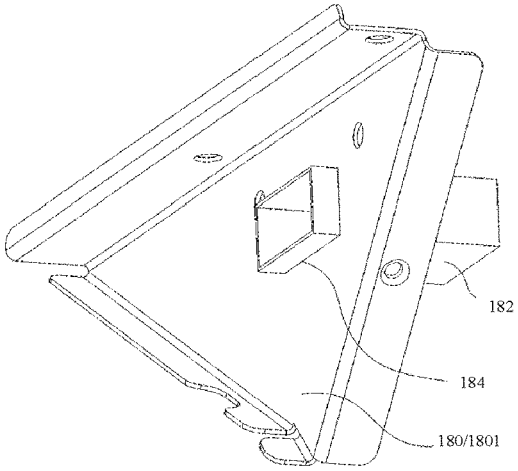
FIG. 9 is another structural diagram of a connecting plate, in accordance with some embodiments.
Figure 10:
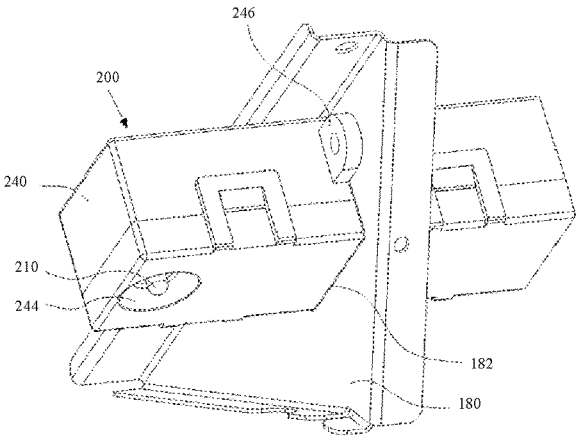
FIG. 10 is another assembly diagram of a connecting plate and a nano water ion generating device in an indoor unit, in accordance with some embodiments.

In some other embodiments, referring to FIGS. 9 and 10, the nano water ion generating device 200 is inserted into the connecting plate 180. For example, a portion of the nano water ion generating device 200 is located in the piping box 170, and another portion is located outside the piping box 170 and proximate to the air outlet 120.

[Nano Water Ion Generating Device]

Referring to FIGS. 1B to 3, the nano water ion generating device 200 is configured to generate nano water ions with negative charges and hydroxyl radicals generated by ionized water.

The negative charges may charge the particles in the air and promote the agglomeration of the particles in the air, so that the particles in the air will increase in volume and weight and then settle to the ground. Or, the charged particles will be adsorbed to the nearest zero potential (the ground), thereby removing the particles (e.g., PM2.5) from the air.

The hydroxyl radicals generated by the ionized water in the nano water ions have extremely strong oxidizing properties. When coming into contact with bacteria and viruses on the surface of particles or in the air, the hydroxyl radicals seize hydrogen elements from the bacterial cell wall, thereby disrupting the structure of the cell wall and causing the cell to become inactive. In addition, due to its strong oxidative action, the hydroxyl radicals may also induce protein denaturation, thereby achieving sterilization and disinfection.

The nano water ion generating device 200 is disposed at the air outlet 120, and the generated nano water ions are directly blown into indoors, which is conducive to improving the air purification effect.

Figure 14:
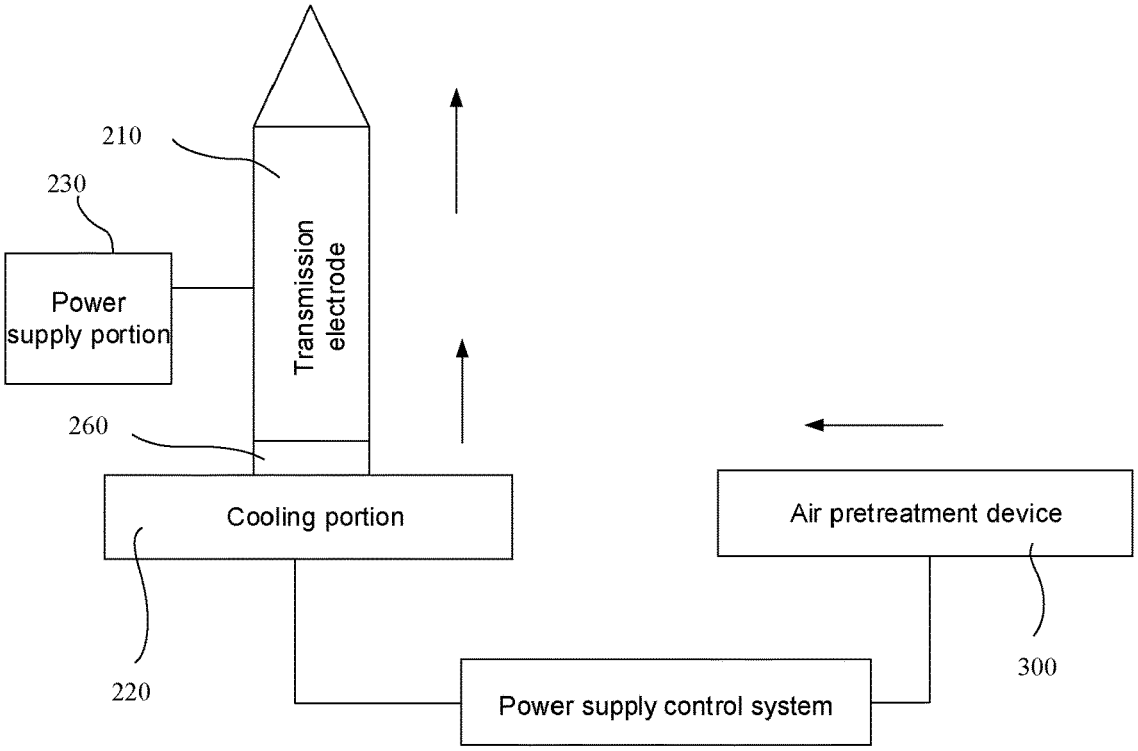
FIG. 14 is a diagram showing a principle of a nano water ion generating device and an air pretreatment device in an indoor unit, in accordance with some embodiments.

Referring to FIG. 14, the nano water ion generating device 200 includes the transmission electrode 210, the cooling portion 220, and the power supply portion 230. The cooling portion 220 is configured to generate condensed water for ionization of the transmission electrode 210. The power supply portion 230 is coupled to the transmission electrode 210 and is configured to provide negative high voltage to the transmission electrode 210, so as to ionize and excite the moisture on the transmission electrode 210 through the high voltage and generate negatively charged nano water ions. A potential of the voltage provided by the power supply portion 230 is a negative potential, and an absolute value of the voltage is in a range from 10 kV to 220 kV, which is a negative high voltage.

In some embodiments, the transmission electrode 210 is hydrophilic, so as to guide the condensed water generated by the cooling portion 220 to the transmission tip of the transmission electrode 210. After the transmission electrode 210 is connected to the negative high voltage, the negatively charged nano water ions may be ionized and excited at the transmission tip.

In some embodiments, the transmission electrode 210 includes a water absorbing member, and a bactericidal material (e.g., silver ions, etc.) is added to the water absorbing member. The transmission electrode 210 receives the negative high voltage provided by the power supply portion 230 and is charged. The moisture in the water absorbing member of the transmission electrode 210 is ionized and excited by the high voltage to generate nano water ions, and the nano water ions carry negative charges and hydroxyl radicals generated by ionized water.

Figure 18:
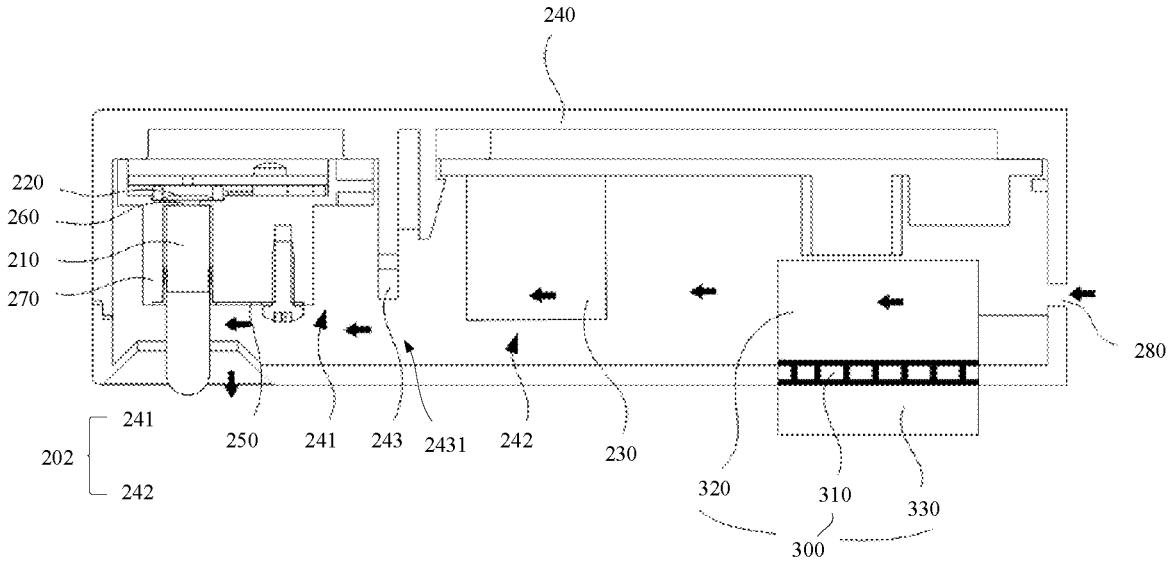
FIG. 18 is a diagram showing a flow path of gas in an air pretreatment device disposed in a nano water ion generating device, in accordance with some embodiments.

The cooling portion 220 is configured to generate condensed water. Referring to FIGS. 14 and 18, there is a water storage gap 260 between an end of the transmission electrode 210 and the cooling portion 220. The condensed water generated by the cooling portion 220 is stored in the water storage gap 260. The transmission electrode 210 utilizes its hydrophilicity to guide the condensed water in the water storage gap 260 to the transmission tip thereof.

The ability of the cooling portion 220 to generate the condensed water is related to a temperature difference between the surrounding air. The greater the temperature difference, the stronger the ability to generate condensed water. Conversely, the less the temperature difference, the weaker the ability to generate condensed water.

In some embodiments, referring to FIGS. 5, 6, and 18, the nano water ion generating device 200 further includes a second housing 240 (i.e., the device housing). The transmission electrode 210, the cooling portion 220, and the power supply portion 230 are disposed in the second housing 240.

The second housing 240 may be made of insulating material (e.g., polypropylene). The second housing 240 includes the nano water ion outlet 244 for exposing the transmission tip of the transmission electrode 210. In some embodiments, the nano water ion outlet 244 faces towards the air outlet 120.

A size of the nano water ion outlet 244 gradually increases in a direction proximate to the transmission tip of the transmission electrode 210. By gradually increasing the nano water ion outlet 244, static electricity accumulation on the second housing 240 may be effectively avoided, thereby releasing higher concentration of negative oxygen ions.

In a case where the air in the air duct 102 flows out through the air outlet 120, it will not directly blow the transmission electrode 210, so as to avoid affecting the outlet air temperature and further affecting the condensation effect of the cooling portion 220 on the air. The second housing 240 includes a second accommodating space 202 (as shown in FIG. 18), and the second accommodating space 202 is communicated to the piping box 170 through a vent. The second vent 280 of the nano water ion generating device 200 is disposed at a side of the second housing 240 proximate to the piping box 170.

Referring to FIG. 5, the nano water ion generating device 200 further includes the fixed installation member 504. The fixed installation member 504 is disposed on the second housing 240 and connected to the connecting plate 180. The nano water ion outlet 244 is disposed at a side of the second housing 240 away from the indoor heat exchanger 130, and the air in the nano water ion generating device 200 enters the indoors through the nano water ion outlet 244. The transmission electrode 210 is disposed in the nano water ion outlet 244.

Referring to FIGS. 5 and 11, the fixed installation member 504 includes mounting ears 246 located at both sides of the second housing 240 and disposed proximate to the connecting plate 180. The mounting ear includes a through hole 2461, through which screws pass, so as to achieve the installation of the nano water ion generating device 200. The second ventilation opening 280 is located at a side of the second housing 240 where the fixed installation member 504 is disposed. The nano water ion outlet 244 is disposed on a side of the second housing 240, and the transmission electrode 210 is located at the middle of the nano water ion outlet 244. The airflow in the nano water ion generating device 200 flows from the second vent 280, through the second accommodating space 202, and then is discharged from the nano water ion outlet 244. The air containing the nano water ions is sent into the indoor air due to the spray action of the transmission electrode 210, so as to achieve the corresponding air purification function.

In some embodiments, as shown in FIG. 18, the nano water ion generating device 200 includes a second partition plate 243, and the second partition plate 243 is disposed in the second accommodating space 202. The second partition plate 243 is configured to devide the second accommodating space 202 into a third sub-space 241 and a fourth sub-space 242, and the second partition plate 243 includes an opening portion 2431 for gas flow.

The transmission electrode 210 and the cooling portion 220 are disposed in the third sub-space 241, and the power supply portion 230 is disposed in the fourth sub-space 242. The second vent 280 is communicated with the fourth sub-space 242.

The air outside the nano water ion generating device 200 flows into the second accommodating space 202 through the second vent 280, flows through the fourth sub-space 242 and the third sub-space 241 in sequence, and reaches the cooling portion 220, so as to generate the condensate water at the cooling portion 220 and supply the condensate water to the transmission tip of the transmission electrode 210. The nano water ions excited by the high voltage ionization flow out through the nano water ion outlet 244 and flow into indoors through the air outlet 120. A direction of the air flow is shown by arrows in FIG. 18.

In some embodiments, referring to FIGS. 5 and 6, the second housing 240 includes a bottom housing 247 and a cover 248. The bottom housing 247 includes a clamping portion 2471, and the cover 248 includes a buckle 2481. The buckle 2481 is clamped to the clamping portions 2471, so as to facilitate the fixed connection between the bottom housing 247 and the cover 248.

The second housing 240 includes a wiring opening 245. The wiring opening 245 is disposed at a side edge of the bottom housing 247 proximate to the cover 248 for easy wiring. The nano water ion outlet 244 is disposed on the cover 248.

In some embodiments, referring to FIG. 18, the nano water ion generating device 200 further includes an insulated electrode fixing base 270, and the electrode fixing base 270 is disposed in the third sub-space 241. The electrode fixing base 270 includes an electrode mounting hole 21A, and the transmission electrode 210 is disposed in the electrode mounting hole 21A.

The nano water ion generating device 200 further includes a conductive portion 250 (e.g., a conductive plate). The conductive portion 250 is disposed at an end of the electrode fixing base 270 proximate to the cover 248. The conductive portion 250 includes an elastic clamping arm 22A. The elastic clamping arm 22A extends into the electrode mounting hole 21A and is in contact with the transmission electrode 210. The conductive portion 250 is electrically connected to the power supply portion 230.

The cooling portion 220 is disposed at an end of the electrode fixing base 270 away from the cover 248 and facing the electrode mounting hole 21A. The water storage gap 260 is formed between the cooling portion 220, the electrode mounting hole 21A, and an end of the transmission electrode 210 proximate to the cooling portion 220.

Figure 8:
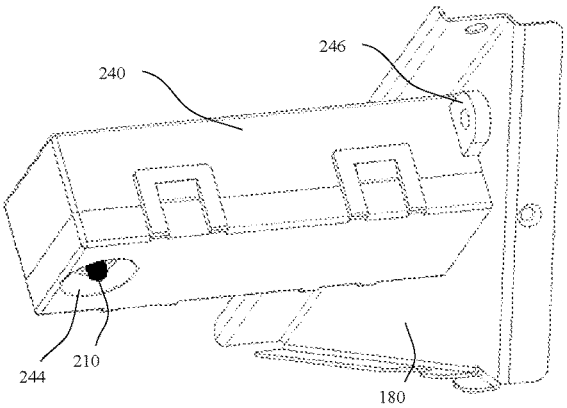
FIG. 8 is an assembly diagram of a connecting plate and a nano water ion generating device in an indoor unit, in accordance with some embodiments.

In some embodiments, referring to FIGS. 7 to 9, the second housing 240 includes the mounting ears 246, and the mounting ears 246 are fixed on the connecting plate 180 through connectors (e.g. screws), so as to implement the fixation of the nano water ion generating device 200 at the air outlet 120.

[Installation of the Nano Water Ion Generating Device]

Referring to FIGS. 5, 7, and 8, the nano water ion generating device 200 is connected (e.g., through bolt) to the second fixing portion 183 through the fixed installation member 504.

Referring to FIGS. 9 and 10, compared with FIGS. 7 and 8, the main difference is that the second fixing portion 183 and the third vent 184 together form an installation opening. The nano water ion generating device 200 is installed at the installation opening, and a portion of the nano water ion generating device 200 is located inside the piping box 170. In this way, the adverse effects on the condensation effect and working stability of the nano water ion generating device 200 caused by the drastic changes in temperature and humidity at the air outlet 120 during cooling or heating of the indoor unit 10 may be reduced.

In some embodiments, referring to FIG. 11, the indoor heat exchanger 130 is installed obliquely in the first housing 100, the nano water ion generating device 200 is installed at a side of the indoor heat exchanger 130 proximate to the air outlet 120, and the transmission electrode 210 of the nano water ion generating device 200 is perpendicular to a plane where the indoor heat exchanger 130 is located.

In some embodiments, an included angle between the transmission electrode 210 of the nano water ion generating device 200 and a plane where the air outlet 120 is located (e.g., a vertical plane where the air outlet 120 is located) is any value in a range from 30° to 60° (e.g., 30°, 45° or 60°). In this way, on the one hand, it may be effectively prevented that the air from the air outlet 120 blows onto the transmission electrode 210 directly, causing insufficient water condensation on the transmission electrode 210, thereby affecting the generation of the nano water ions. On the other hand, the blowing from this angle may increase the concentration of the nano water ions, so as to achieve better purification effects.

In some embodiments, the nano water ion generating device 200 is installed on the connecting plate 180 of the indoor unit 10, and the transmission electrode 210 of the nano water ion generating device 200 is driven by the ion wind and the negative pressure of the air outlet 120 to actively release the nano water ions into the air. The nano water ion generating device 200 is provided with the cooling portion 220 therein, so as to cool the water in the air.

Figure 12:
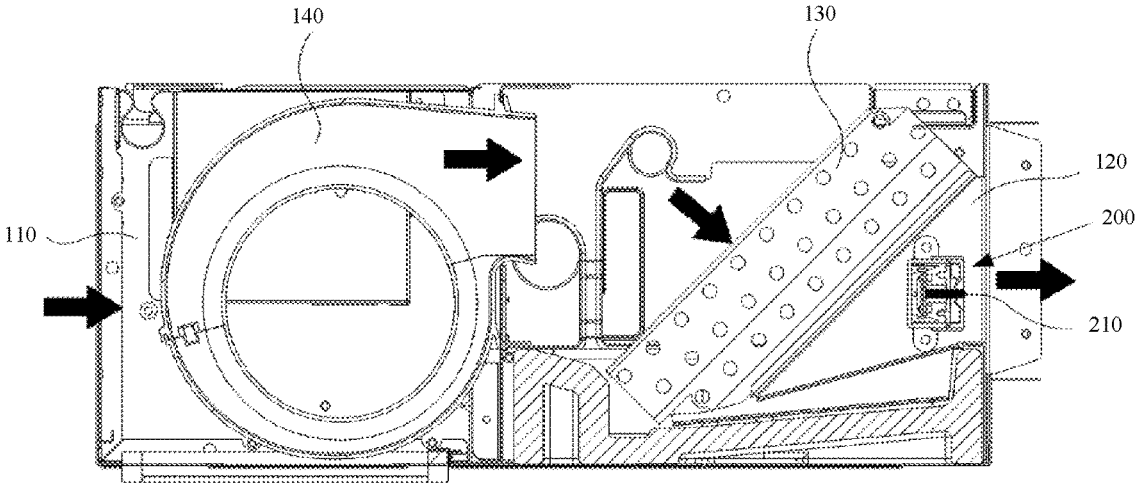
FIG. 12 is another installation diagram of a nano water ion generating device in an indoor unit, in accordance with some embodiments.

In order to achieve a better air purification effect, in some other embodiments, referring to FIG. 12, compared with FIG. 11, the main difference is that the transmission electrode 210 of the nano water ion generating device 200 is perpendicular to a plane where the air outlet 120 is located (e.g., a plane where the front side wall is located). For example, the transmission tip of the transmission electrode 210 is disposed towards the air outlet 120.

Figure 13:
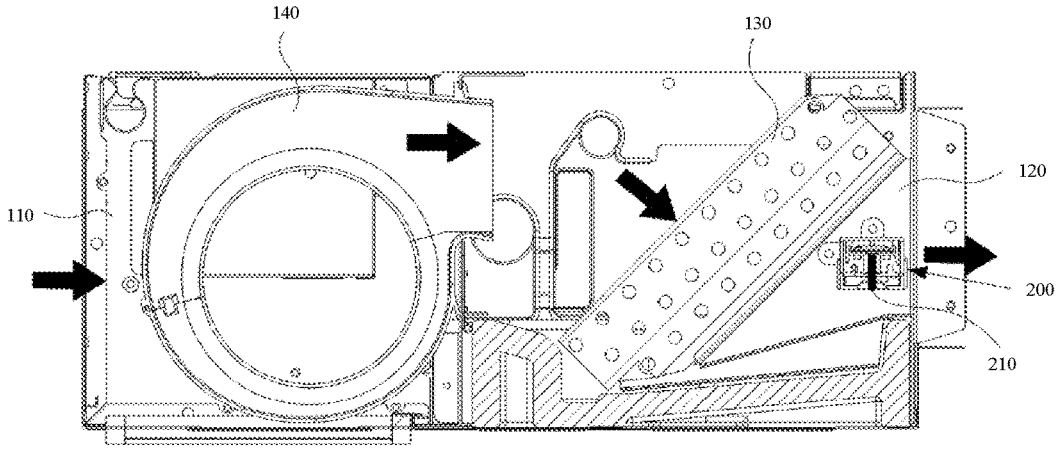
FIG. 13 is yet another installation diagram of a nano water ion generating device in an indoor unit, in accordance with some embodiments.

In some embodiments, referring to FIG. 13, compared with FIG. 11, the main difference is that the transmission electrode 210 of the nano water ion generating device 200 is parallel to the plane where the air outlet 120 is located (e.g., the plane where the front side wall is located). For example, the transmission tip of the transmission electrode 210 is disposed towards the bottom wall of the first housing 100. In this way, the installation method of the nano water ion generating device 200 may be flexibly selected according to needs.

In the case shown in FIGS. 12 and 13, the nano water ion generating device 200 may be integrally installed on the second fixing portion 183. Alternatively, the second fixing portion 183 and the third vent 184 jointly form the installation opening. The nano water ion generating device 200 is installed at the installation opening, and a portion of the nano water ion generating device 200 is located inside the piping box 170.

The indoor unit 10 according to some embodiments of the present disclosure includes the first housing 100 that includes the first accommodating space 101, the return air inlet 110, and the air outlet 120. The return air inlet 110 and the air outlet 120 are respectively communicated to the first accommodating space 101. The fan 140 is disposed in the first accommodating space 101 and is opposite to the return air inlet 110. The indoor heat exchanger 130 is disposed at the side of the fan 140 proximate to the air outlet 120. The piping box 170 is disposed at a side of the first housing 100 proximate to the air outlet 120. The nano water ion generating device 200 is disposed on the side wall of the first housing 100 proximate to the air outlet 120. The nano water ion generating device 200 and the piping box 170 are communicated through the vent therebetween, so that the air in the piping box 170 enters the nano water ion generating device 200 through the vent, and the air containing nano water ions is sent to the indoors through the nano water ion outlet 244.

In this way, the air in the piping box 170 is introduced into the nano water ion generating device 200, and the air mixed with the nano water ions is discharged into indoors through the nano water ion outlet 244, so that a separate gas channel is provided for the nano water ion generating device 200. Therefore, the influence of the temperature and humidity of the air at the air outlet 120 on the nano water ion generating device 200 may be prevented, which is conducive to improving the water condensation capability of the nano water ion generating device 200 and improving the air purification capability of the indoor unit 10.

In addition, compared with the method of connecting the nano water ion generating device 200 and the piping box 170 through pipelines, the indoor unit 10 provided by some embodiments of the present disclosure is communicated with the nano water ion generating device 200 and the piping box 170 through the vents, which is conducive to improving the compactness of the components inside the indoor unit 10, improving the reliability of the connection between the nano water ion generating device 200 and the piping box 170, and omitting the accessories such as pipelines, thereby reducing the manufacturing cost of the air conditioner.

In order to prevent the temperature and humidity of the air at the air outlet 120 from changing beyond a preset threshold when the indoor unit 10 performs cooling or heating, thereby causing the adverse effect on the water condensation ability of the nano water ion generating device 200, the indoor unit 10 according to some embodiments of the present disclosure is provided with the separate gas channel, so that the nano water ion generating device 200 may smoothly spray the nano water ions.

For example, the air enters the inside of the nano water ion generating device 200 from the piping box 170 and through the first vent 1701, the third vent 184, and the second vent 280. And then, the air containing the nano water ions is discharged into indoors through the nano water ion outlet 244 for indoor air purification.

It will be noted that although the air inside the piping box 170 is humid, it is not affected by the temperature and humidity conditions at the air outlet 120 of the indoor unit 10. Therefore, it will not affect the water condensation ability of the nano water ion generating device 200.

[Air Pretreatment Device, Piping Box]

Some embodiments of the present disclosure provide an air conditioner in which the cooling portion 220 is no longer used to cool the transmission electrode 210 but is configured to generate condensed water. Then, the hydrophilicity of the transmission electrode 210 is utilized to guide the condensed water to the transmission tip, and the air pretreatment device 300 is used to increase the temperature difference at the cooling portion 220 and improve the ability of the cooling portion 220 to generate the condensed water, thereby ensuring that the transmission electrode 210 may still obtain enough moisture used for discharging at the transmission tip even when the humidity is low, so as to generate the nano water ions and improve the air purification effect of the air conditioner 1000.

Since the nano water ion generating device 200 is disposed at the air outlet 120, the temperature of the surrounding air is greatly affected by the air outlet temperature of the air outlet 120, which may affect the water condensation capacity of the cooling portion 220. In order to solve the above problem, in some embodiments of the present disclosure, referring to FIG. 19, the indoor unit 10 further includes the air pretreatment device 300. The air pretreatment device 300 will be described below.

Referring to FIGS. 2 and 3, the air ducts 102 of the indoor unit 10 include a first air duct 1021 and a second air duct 1022 that are communicated with each other. The first air duct 1021 is further away from the air outlet 120 than the second air duct 1022. For example, the first air duct 1021 is located at an upstream side of the indoor heat exchanger 130, and the second air duct 1022 is located at a downstream side of the indoor heat exchanger 130.

In the related art, a side of the piping box 170 away from the air outlet 120 (e.g., a rear side) is communicated to the first air duct 1021 (e.g., the upstream air duct), and a side of the piping box 170 proximate to the air outlet 120 (e.g., a front side) is closed. A portion of the air flowing into the air duct 102 from the return air inlet 110 will not pass through the indoor heat exchanger 130, but will flow into the piping box 170. Since the front side of the piping box 170 is closed, the air in the piping box 170 will not continue to flow outwards. Therefore, most of the air filled in the piping box 170 is air before heat exchange.

In view of this, some embodiments of the present disclosure make full use of the space in the piping box 170 and are provided with a vent (e.g., the second vent 280) on the piping box 170, so as to communicate the piping box 170 with the air outlet 120 through the vent. In this way, a portion of the air that flows into the air duct 102 from the return air inlet 110 and has not been heat exchanged by the indoor heat exchanger 130 will flow into the piping box 170 and then flow to the nano water ion generating device 200 at the air outlet 120 through the second vent 280.

Therefore, the piping box 170 plays a role of branching and guiding, that is, the portion of the air in the first air duct 1021 that has not been heat exchanged may be guided to the nano water ion generating device 200 through the piping box 170.

In some embodiments, the air pretreatment device 300 is disposed on the air flow path between the piping box 170 and the nano water ion generating device 200 and is configured to preheat or precool the air flowing through the cooling portion 220, so as to improve the temperature difference of the air surrounding the cooling portion 220 and increase the ability of the cooling portion 220 to generate the condensed water, so that the transmission electrode 210 may still obtain enough moisture for tip discharge, so as to generate the nano water ions and improve the air purification effect of the air conditioner 1000.

A portion of the air flowing into the air duct 102 from the return air inlet 110 flows out of the air outlet 120 after exchanging heat with the indoor heat exchanger 130, and another portion does not pass through the indoor heat exchanger 130, but flows into the piping box 170, and then flows into the second accommodating space 202 of the second housing 240 through the second vent 280. During the process that the air flows from the piping box 170 to the cooling portion 220, the air will flow through the air pretreatment device 300 to be preheated or precooled, so as to increase the temperature difference of the air at the cooling portion 220 and improve the ability of the cooling portion 220 to generate the condensed water.

Figure 15:
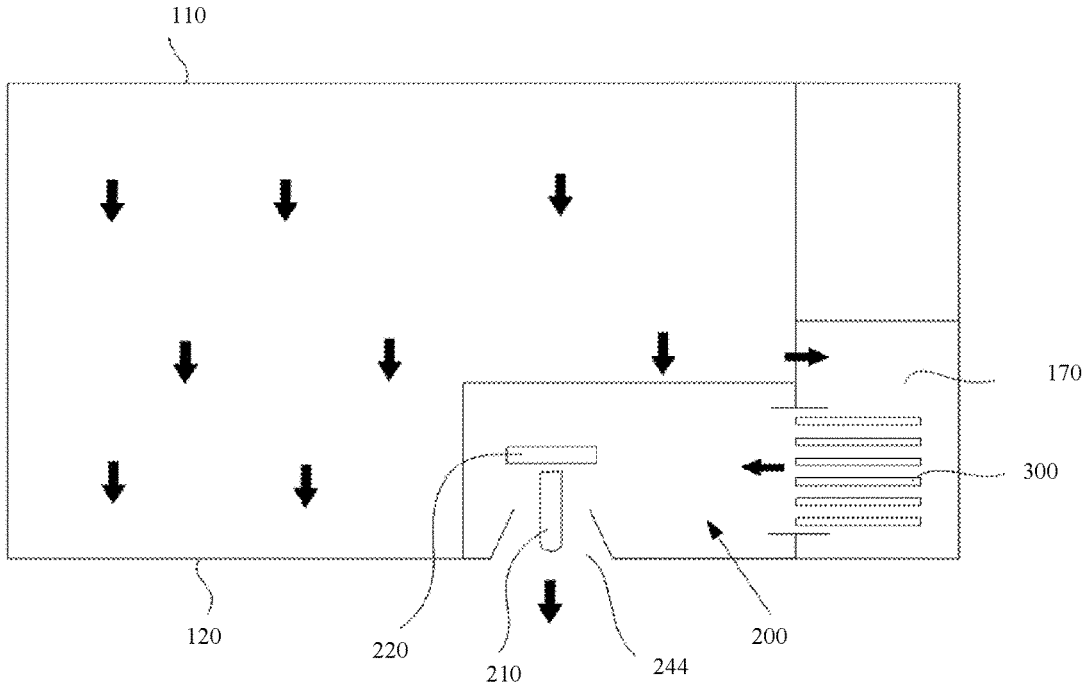
FIG. 15 is a diagram showing a flow path of gas in an air pretreatment device disposed in a piping box, in accordance with some embodiments.
Figure 21:
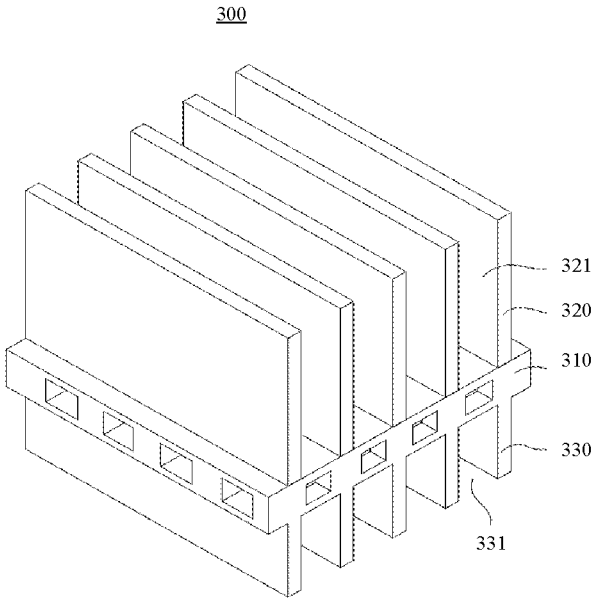
FIG. 21 is a structural diagram of an air pretreatment device, in accordance with some embodiments.

In some embodiments, referring to FIGS. 15 and 21, the air pretreatment device 300 includes a cooling sheet 310, a first heat exchange plate 320, and a second heat exchange plate 330. Two opposite sides of the cooling sheet 310 along a thickness direction are respectively a first side and a second side. The first heat exchange plate 320 is disposed at the first side of the cooling sheet 310, and the second heat exchange plate 330 is disposed at the second side of the cooling sheet 310.

Figure 16:
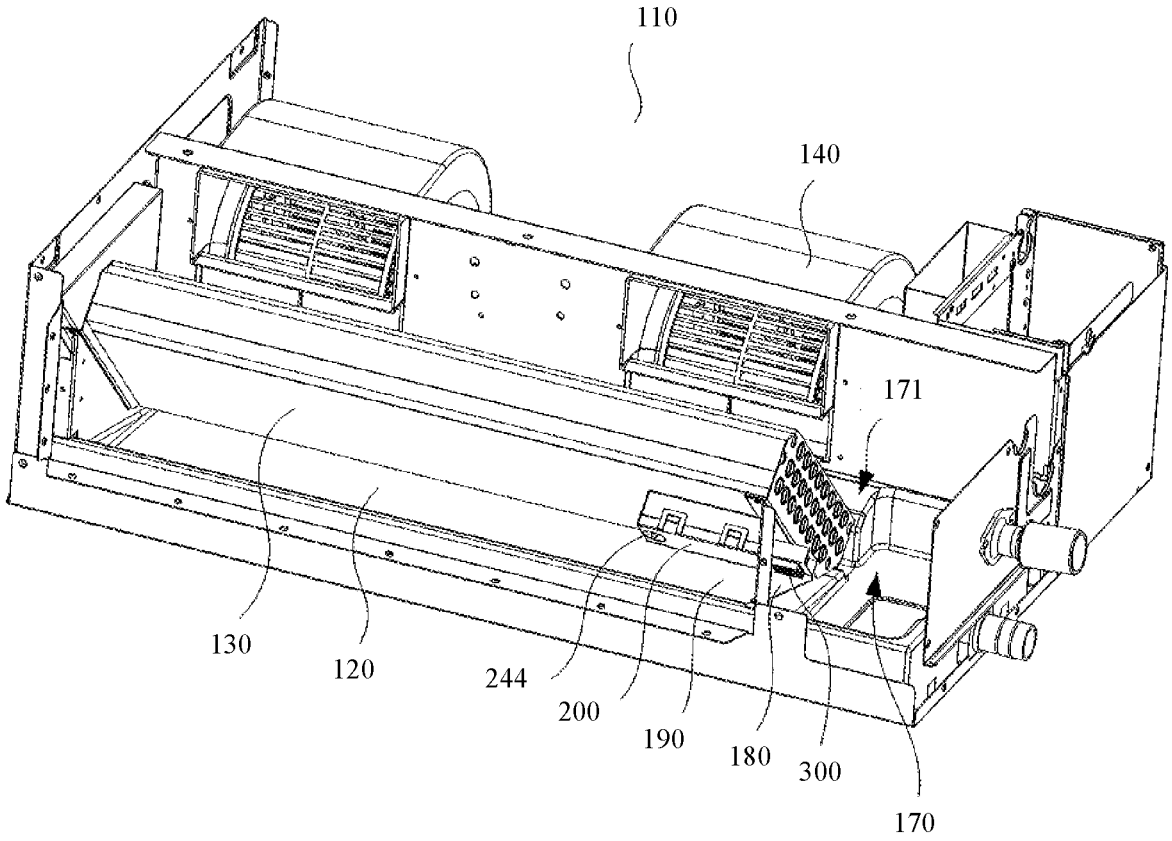
FIG. 16 is a structural diagram of an air pretreatment device disposed in a piping box, in accordance with some embodiments.

Referring to FIGS. 16 and 18, the first heat exchange plate 320 is located on an air flow path between an air inlet 171 of the piping box 170 and the cooling portion 220. The second heat exchange plate 330 is located outside the air flow path between the air inlet 171 of the piping box 170 and the cooling portion 220.

In a case where the first side of the cooling sheet 310 is cooling and the second side is heating, the first heat exchange plate 320 is a heat absorption plate and the second heat exchange plate 330 is a heat dissipation plate. In a case where the first side of the cooling sheet 310 is heating and the second side is cooling, the first heat exchange plate 320 is a heat dissipation plate and the second heat exchange plate 330 is a heat absorption plate.

In a case where the air conditioner 1000 executes the cooling operation mode, the temperature at the air outlet 120 is relatively low. In this case, the air pretreatment device 300 turns on a preheating mode to preheat the air flowing from the piping box 170 to the cooling portion 220. In this case, the first heat exchange plate 320 is a heat dissipation plate, and the second heat exchange plate 330 is a heat absorption plate. In a case where the air flows through the air pretreatment device 300, the air is heated by the heat generated by the first heat exchange plate 320, and the temperature is increased, thereby increasing the temperature difference at the cooling portion 220 and improving the water condensation capacity of the cooling portion 220.

In a case where the air conditioner 1000 executes the heating operation mode, the temperature at the air outlet 120 is relatively high. In this case, the air pretreatment device 300 turns on the a precooling mode to precool the air flowing from the piping box 170 to the cooling portion 220. In this case, the first heat exchange plate 320 is a heat absorption plate and the second heat exchange plate 330 is a heat dissipation plate. In a case where the air flows through the air pretreatment device 300, the heat of the air is absorbed by the first heat exchange plate 320, and the temperature of the air is lowered, thereby increasing the temperature difference at the cooling portion 220 and improving the water condensation capacity of the cooling portion 220.

In some embodiments, referring to FIG. 21, the air pretreatment device 300 includes a first ventilation gap 321 and a plurality of first heat exchange plates 320 disposed at intervals. The first ventilation gap 321 is formed between two adjacent first heat exchange plates 320, so that the air flows through the first ventilation gap 321 to improve heat exchange efficiency.

The air pretreatment device 300 includes a second ventilation gap 331 and a plurality of second heat exchange plates 330 disposed at intervals. The second ventilation gap 331 is formed between two adjacent second heat exchange plates 330 to improve the heat exchange efficiency.

Referring to FIGS. 2 and 3, the piping box 170 is disposed at an end of the first housing 100 along a extending direction (e.g., a length direction) and is located in the first sub-space 161. An end of the piping box 170 away from the air outlet 120 is formed with an opening. The opening is disposed towards the air duct 102. The opening, the indoor heat exchanger 130, and the first partition plate 150 jointly define the air inlet 171 of the piping box 170 (refer to FIG. 16).

Referring to FIGS. 11 and 16, the side of the indoor heat exchanger 130 proximate to the air outlet 120 (e.g., the front side) is provided with a connecting plate 180. The connecting plate 180 is respectively connected to an inner bottom wall 190 (e.g., the water pan 6A) of the first housing 100 and the front side wall of the first housing 100, so as to separate the piping box 170 from the second air duct 1022 (e.g., the downstream air duct). The nano water ion generating device 200 is disposed on the connecting plate 180.

In some embodiments, referring to FIG. 16, a portion (e.g., the top) of the indoor heat exchanger 130 away from the inner bottom wall 190 is inclined towards a direction proximate to the air outlet 120. The connecting plate 180 is disposed in a space formed between the indoor heat exchanger 130, the inner bottom wall 190 of the first housing 100, and the front side wall of the first housing 100.

It will be noted that the inner bottom wall 190 is connected to the bottom wall of the first housing 100, and the inner bottom wall 190 of the first housing 100 is closer to the first accommodating space 101 than the bottom wall.

[Installation Position of Air Pretreatment Device]

The air pretreatment device 300 may be disposed in the piping box 170 or in the nano water ion generating device 200.

In some embodiments, referring to FIG. 15, the air pretreatment device 300 is disposed in the piping box 170.

Referring to FIG. 9, the connecting plate 180 includes a body 1801, a third vent 184, and a mounting portion 182 (e.g., a mounting hole). The third ventilation port 184 extends through the body 1801 along a thickness direction. The mounting portion 182 is inserted into the third vent 184. For example, a portion of the mounting portion 182 is located in the piping box 170, and another portion of the mounting portion 182 is opposite to and is communicated with the second vent 280, so that an inner cavity of the piping box 170 may be communicated with the second accommodating space 202 of the second housing 240.

Figure 17:
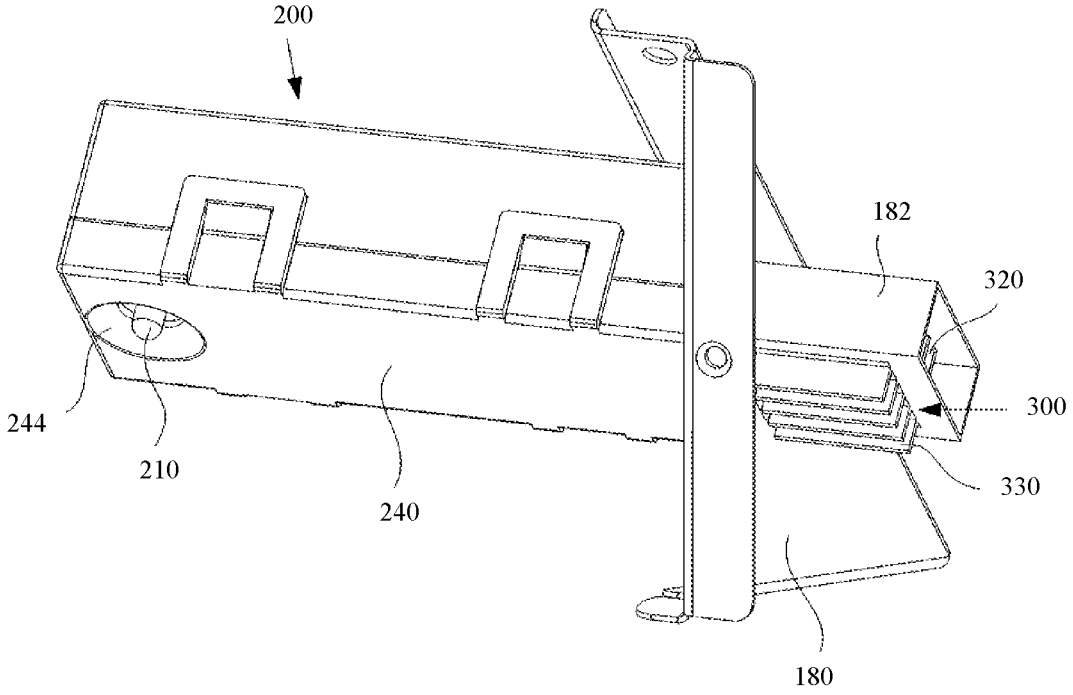
FIG. 17 is an installation structural diagram of an air pretreatment device and a nano water ion generating device, in accordance with some embodiments.

Referring to FIG. 17, the cooling sheet 310 is disposed on the portion of the mounting portion 182 located in the piping box 170, the first heat exchange plate 320 is located in an inner cavity of the mounting portion 182, and the second heat exchange plate 330 is located outside the mounting portion 182.

The air in the piping box 170 flows into the second accommodating space 202 of the second housing 240 through the inner cavity of the mounting portion 182. And then, the air is in contact with the first heat exchange plate 320 when flowing through the inner cavity of the mounting portion 182 and flows through the first ventilation gap 321, so as to achieve the preheating or precooling of the air.

Figure 19:
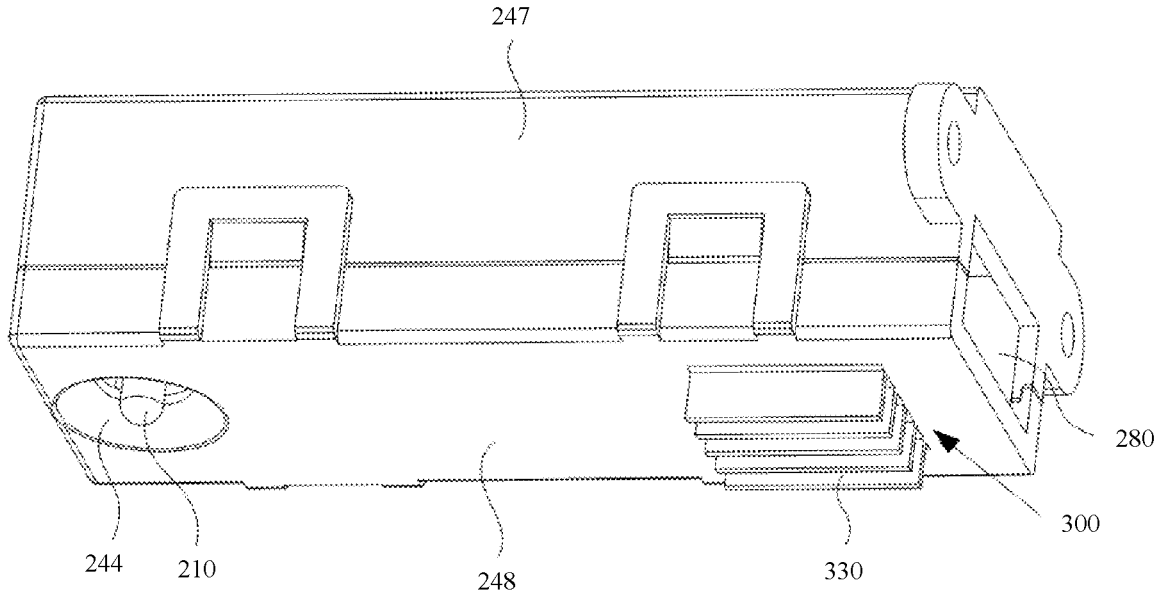
FIG. 19 is a structural diagram of an air pretreatment device and a nano water ion generating device, in accordance with some embodiments.
Figure 20:
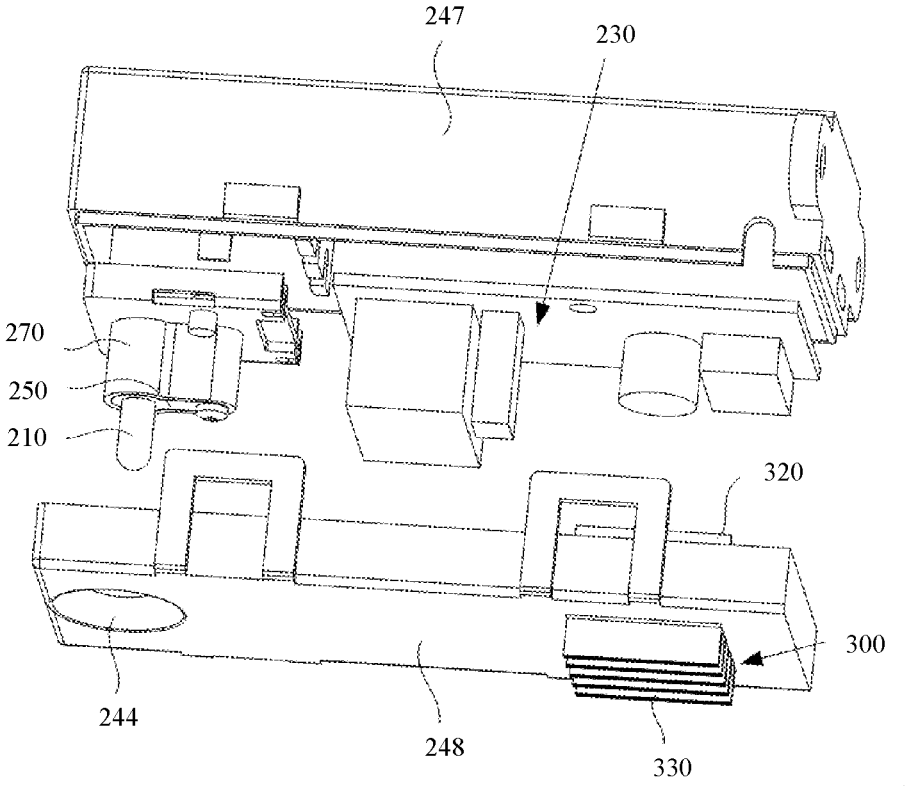
FIG. 20 is an exploded view of the air pretreatment device and the nano water ion generating device in FIG. 19.

In some other embodiments, referring to FIGS. 18 to 20, the main difference from FIGS. 15 to 17 is that the position of the air pretreatment device 300 is different. The air pretreatment device 300 is disposed in the nano water ion generating device 200.

The cooling sheet 310 is disposed on the cover 248 of the second housing 240, the first heat exchange plate 320 is located in the second accommodating space 202 (e.g., the fourth sub-space 242) of the second housing 240, and the second heat exchange plate 330 is located outside the second housing 240.

The air in the piping box 170 flows into the fourth sub-space 242 of the second housing 240 through the inner cavity of the second vent 280 and then continues to flow towards the third sub-space 241. During this process, the air is in contact with the first heat exchange plate 320 and flows through the first ventilation gap 321, so as to achieve the preheating or precooling of the air.

[Control Method of Air Pretreatment Device]

Figure 28:
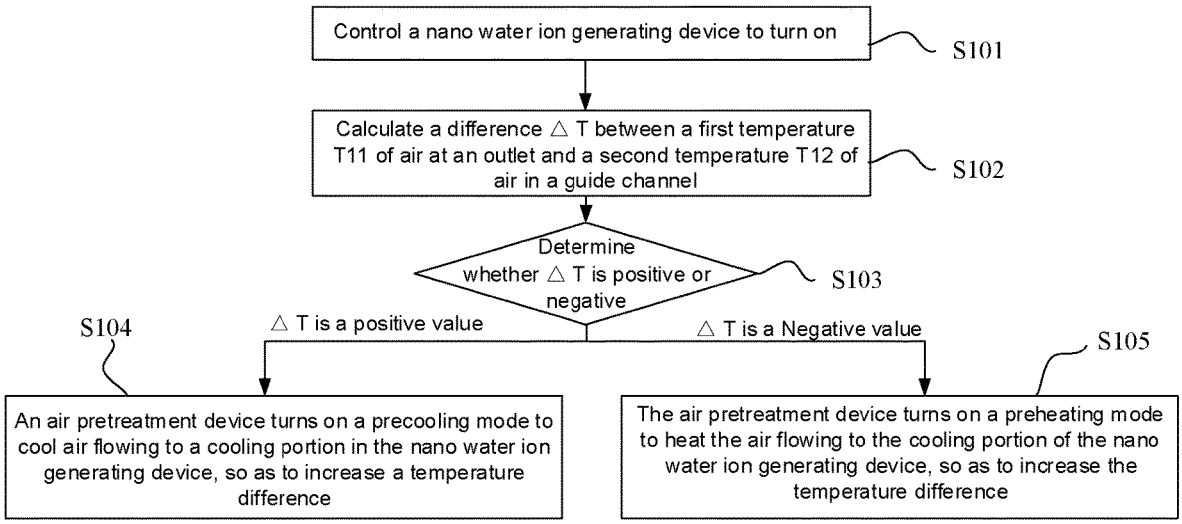
FIG. 28 is a flow chart of a nano water ion generating device and an air pretreatment device in an indoor unit, in accordance with some embodiments.

In some embodiments, referring to FIG. 28, a control method includes steps S101 to S105.

In step S101, the nano water ion generating device 200 is controlled to be turned on.

In step S102, a difference ΔT between a first temperature T11 of the air at the air outlet and a second temperature T12 of the air in the flow guide channel is calculated. Here, the flow guide channel refers to the inner cavity of the piping box 170.

In step S103, it is determined whether ΔT is positive or negative. If ΔT is greater than 0, step S104 is performed; if ΔT is less than 0, step S105 is performed.

In step S104, in a case where it is determined that ΔT is greater than 0, the air pretreatment device 300 turns on the precooling mode to cool the air flowing to the cooling portion 220 in the nano water ion generating device 200, so as to increase the temperature difference.

In step S105, in a case where it is determined that ΔT is less than 0, the air pretreatment device 300 turns on the preheating mode to heat the air flowing to the cooling portion 220 of the nano water ion generating device 200, so as to increase the temperature difference.

That is, in a case where the difference ΔT between the first temperature T11 of the air at the air outlet 120 and the second temperature T12 of the air in the piping box 170 is greater than 0, it indicates that the air conditioner 1000 is in the heating operation mode and the air pretreatment device 300 precools the air flowing through the cooling portion 220.

In a case where the difference ΔT between the first temperature T11 of the air at the air outlet 120 and the second temperature T12 of the air in the piping box 170 is less than 0, it indicates that the air conditioner 1000 is in the cooling operation mode, and the air pretreatment device 300 preheats the air flowing through the cooling portion 220.

In some other embodiments, a control system (or a controller) of the air conditioner 1000 may also directly read the cooling or heating control command of the air conditioner 1000 to directly determine whether the air conditioner 1000 is in the cooling or heating operation mode, thereby further controlling the air pretreatment device 300 to precool or preheat the air flowing through the cooling portion 220.

In some embodiments, the air conditioner 1000 further includes a humidity sensor configured to detect a relative humidity of the air at the air outlet 120. The controller is coupled to the humidity sensor and the air pretreatment device 300, and the controller is configured to control the air pretreatment device 300 to pre-cool or pre-heat the air flowing through the air pretreatment device 300 according to the relative humidity fed back by the humidity sensor.

In some embodiments, the controller obtains a relative humidity Rh of the air at the air outlet 120 and adjusts the air pretreatment device 300 to be turned on or turned off, controls the air pretreatment device 300 to switch between the precooling mode and the preheating mode according to the difference ΔT between the first temperature T11 of the air at the air outlet 120 and the second temperature T12 of the air in the piping box 170, and adjusts the cooling capacity or the heating capacity by adjusting the operating power of the precooling mode or the preheating mode of the air pretreatment device 300 to precool or preheat the air flowing through, so as to increase the temperature difference at the cooling portion 220 and improve the water condensation capacity of the cooling portion 220.

In a case where the relative humidity fed back by the humidity sensor is different, the operation mode (e.g., precooling or preheating the air flowing through) of the air pretreatment device 300, under the control of the controller, is also different. In this way, by adjusting the operation mode of the air pretreatment device 300, the temperature difference at the cooling portion 220 may be adjusted, thereby improving the water condensation capacity of the cooling portion 220.

For example, in a case where the relative humidity is greater than or equal to a preset relative humidity (i.e., Rh≥Rh1), it indicates that the humidity is high, the air pretreatment device 300 is turned off, and the moisture may be condensed from the air only by the cooling capacity of the cooling portion 220.

In a case where the relative humidity is less than the preset relative humidity (i.e., Rh<Rh1), it indicates that the humidity is low. If the air conditioner is in the cooling operation mode, the air pretreatment device 300 turns on the preheating mode. If the air conditioner is in the heating mode, then air pretreatment device 300 turns on the precooling mode.

In some embodiments, the heating capacity or cooling capacity of the air pretreatment device 300 is inversely proportional to the relative humidity Rh.

In some embodiments, in a case where the difference ΔT between the first temperature T11 of the air at the air outlet 120 and the second temperature T12 of the air in the piping box 170 is less than the first preset threshold T10, it indicates that the temperature difference is small. In this case, the air pretreatment device 300 is turned on, and the air flowing from the piping box 170 to the cooling portion 220 needs to be pretreated.

In a case where the difference ΔT between the first temperature T11 of the air at the air outlet 120 and the second temperature T12 of the air in the piping box 170 is greater than the second preset threshold T20, the temperature difference is large. In this case, the air pretreatment device 300 is turned off, and the moisture may be condensed from the air only by the cooling capacity of the cooling portion 220.

In some embodiments, the heating or cooling capacity of the air pretreatment device 300 is inversely proportional to the difference ΔT between the first temperature T11 of the air at the air outlet 120 and the second temperature T12 of the air in the piping box 170.

The air pretreatment device 300 may not only prevent excessive water condensation in the cooling portion 220, but also improve the water condensation capacity of the cooling portion 220 under dry conditions.

[Transmission Electrode]

Figure 22:
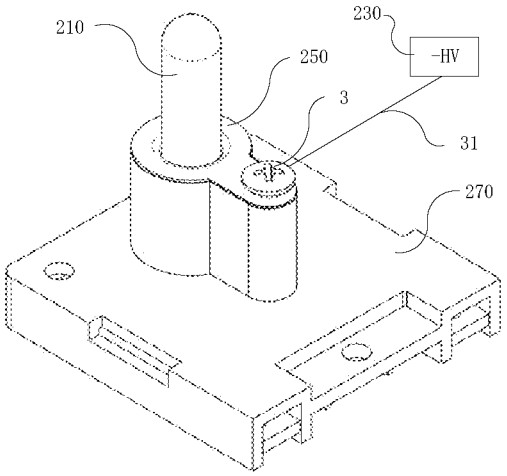
FIG. 22 is a partial structural diagram of a nano water ion generating device, in accordance with some embodiments.

In some embodiments, referring to FIG. 22, the nano water ion generating device 200 includes, in addition to the transmission electrode 210, the conductive portion 250, (e.g., a metal clamping portion) and the electrode fixing base 270, a wiring bolt 3.

Figure 23:
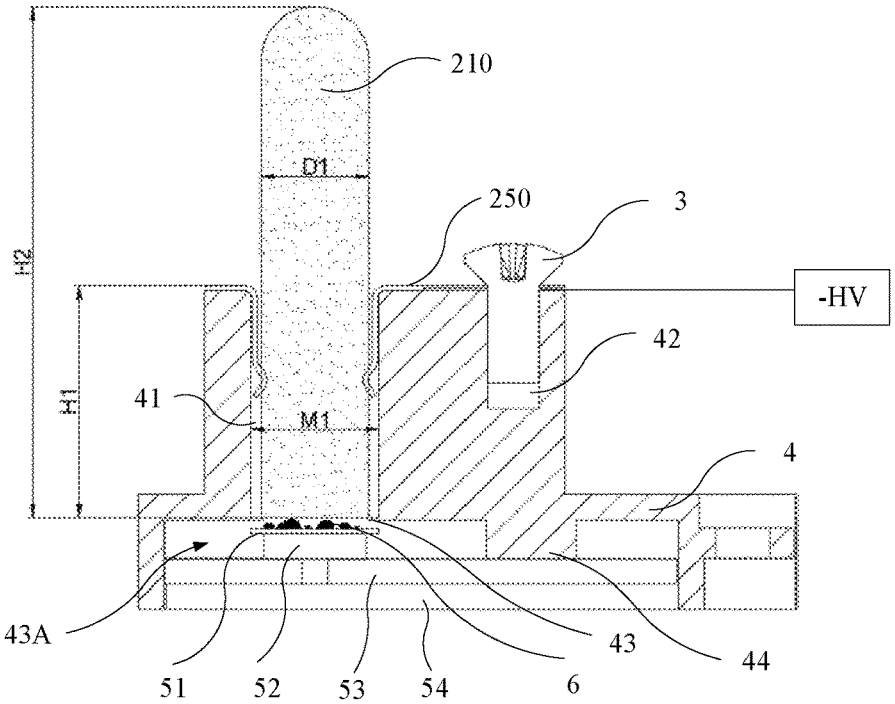
FIG. 23 is a cross-sectional view of the nano water ion generating device in FIG. 22.
Figure 24:
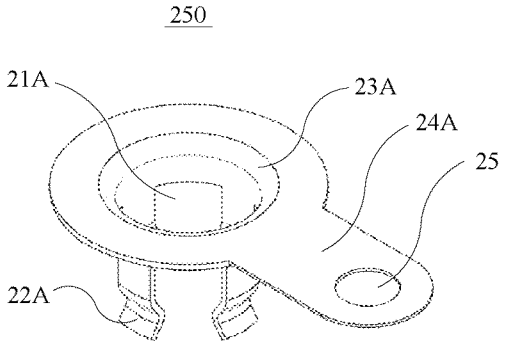
FIG. 24 is a structural diagram of a conductive portion, in accordance with some embodiments.
Figure 25:
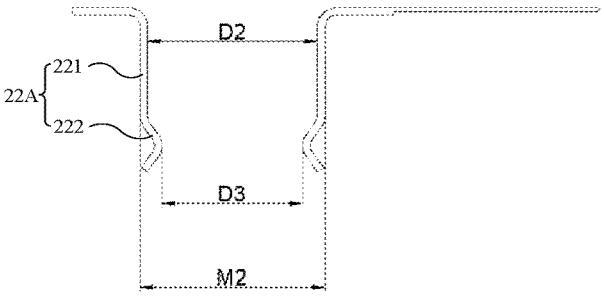
FIG. 25 is a cross-sectional view of a conductive portion, in accordance with some embodiments.

Referring to FIGS. 23 to 25, the third housing 4 includes a first connecting hole 41 and a second connecting hole 42. The conductive portion 250 includes a clamping portion body, an electrode mounting hole 21A, an elastic clamping arm 22A, and a fixed mounting arm 24A. The electrode mounting hole 21A extends through the clamping portion body along a thickness direction, and the transmission electrode 210 is installed in the electrode mounting hole 21A. The elastic clamping arm 22A is disposed proximate to the electrode mounting hole 21A and is connected to the clamping portion body. The transmission electrode 210 is located inside the elastic clamping arm 22A, and a portion of the transmission electrode 210 is in contact with the elastic clamping arm 22A. The elastic clamping arm 22A is located in the first connecting hole 41. The fixed mounting arm 24A is connected to the clamping portion body and extends in a direction away from the clamping portion body (or the electrode mounting hole 21A). The fixed mounting arm 24A is connected to the second connecting hole 42 through the wiring bolt 3.

The elastic clamping arm 22A extends generally in a direction parallel to a center line of the electrode mounting hole 21A, and the fixed mounting arm 24A extends in a radial direction of the electrode mounting hole 21A.

In some embodiments, the conductive portion 250 further includes a mounting chamfer 23A located between the clamping portion body and the elastic clamping arm 22A. The installation chamfer 23A may not only guide the assembly of the transmission electrode 210 but also protect the transmission electrode 210.

The transmission electrode 210 has the ability to absorb and conduct water and is a porous columnar electrode mainly formed by solidifying conductive fiber bundles through a curing agent and carbonizing under high temperature conditions. In an environment with high air humidity, the transmission electrode 210 may directly absorb moisture in the air.

Therefore, the nano water ion generating device 200 is capable of achieving the air purification, disinfection, and sterilization. Correspondingly, the air conditioner 1000 having the nano water ion generating device 200 also has a good air purification effect.

In some embodiments, the conductive portion 250 includes two, three, or more elastic clamping arms 22A. In this way, it is conducive to improving the reliability of the conductive portion 250.

Referring to FIGS. 23 to 25, an outer diameter of the transmission electrode 210 is D1. The elastic clamping arm 22A includes a first section 221 and a second section 222 that are connected with each other. The second section 222 is further away from the clamping portion body than the first section 221, and a portion of the second section 222 is configured to contract in a direction proximate to a center line of the electrode fixing hole 21A. For example, the first section 221 is a straight section, and the second section 222 is a curved section. The first section 221 forms an inner diameter D2 around the electrode fixing hole 21A, and the second section 222 forms an inner diameter D3 (e.g., a minimum inner diameter) around the electrode fixing hole 21A. D1, D2, and D3 satisfy a relationship that D2 is greater than D1, and D1 is greater than D3 (i.e., D2>D1>D3). The bottom end of the transmission electrode 210 is inserted into the electrode fixing hole 21A from the first section 221, and the outer side wall of the transmission electrode 210 is in contact with the portion of the second section 222.

The bottom end of the transmission electrode 210 is inserted into the conductive portion 250 from the electrode mounting hole 21A and is elastically fixed by contacting the elastic clamping arm 22A. The installation chamfer 23A may prevent the collision of the electrode material and the fiber damage caused by the insertion of the transmission electrode 210 into the conductive portion 250. This manner of fixing the electrode allows the transmission electrode 210 to be plug-and-play and is convenient and fast. In this way, it may implement rapid assembly and replacement of the transmission electrode 210 and solve a problem of poor conductive connection of water absorbing electrode materials.

In some embodiments, the elastic clamping arm 22A on the conductive portion 250 extends into the first connecting hole 41. The fixed installation arm 24A includes a fixing hole 25, and the wiring bolt 3 is inserted into the fixing hole 25. On the one hand, the wiring bolt 3 plays a role in fixing the conductive portion 250. On the other hand, the high voltage wire 31 (refer to FIG. 22) is also fixed to the electrode fixing base 270 through the wiring bolt 3.

For example, referring to FIGS. 22 and 23, an end of the transmission electrode 210 is coupled to the power supply portion 230 through a high voltage line 31, thus facilitating the electrical connection between the power supply portion 230 and the transmission electrode 210.

In some embodiments, the electrode fixing base 270 further includes a first boss portion 43, the first boss portion 43 is located at the bottom of the first connecting hole 41, and the bottom end of the transmission electrode 210 is in contact with the first boss portion 43. The first boss portion 43 is configured to control a height of a water absorbing portion of the transmission electrode 210 and play a role in positioning the transmission electrode 210.

Referring to FIG. 23, a distance between the first boss portion 43 and the fixed mounting arm 24A is H1, and a height of the transmission electrode 210 is H2. H1 and H2 satisfy a relationship H1<H2. In this way, the top of the transmission electrode 210 is higher than the upper surface of the electrode fixing base 270, and the transmission electrode 210 exposed in the air may directly absorb moisture in the air.

The generation process of the nano water ions in the nano water ion generating device 200 includes that the wiring bolt 3 is connected to the power supply portion 230, the electrode fixing base 270 is made of insulating material (e.g., polypropylene), and the negative high voltage electricity output by the power supply portion 230 is directly transmitted to the conductive portion 250 through the wiring bolt 3, and then transmitted to the transmission electrode 210 through the elastic clamping arm 22A of the conductive portion 250. After the negative high voltage is applied to the transmission electrode 210, there are countless micropores on the surface of the water absorbing material, and countless nano water ion release points are formed due to the action of the high voltage electric field. The negative high voltage provided by the power supply portion 230 generates corona discharge, thereby ionizing the water to generate the negatively charged nano water ions and sprayed the nano water ions into the air.

The nano water ion generating device 200 in some embodiments of the present disclosure directly uses the ground or surrounding grounded objects as the counter electrode of the transmission electrode 210. There is no need to provide an additional counter electrode. Therefore, the generated negatively charged nano water ions will not be absorbed by the counter electrode.

In some embodiments, the nano water ion generating device 200 does not include the cooling portion 220. In some other embodiments, the nano water ion generating device 200 includes the cooling portion 220. For example, when it is necessary to provide condensed water for the transmission electrode 210, the nano water ion generating device 200 including the cooling portion 220 may be selected. When it is not necessary to provide condensed water for the transmission electrode 210, the nano water ion generating device 200 which does not include the cooling portion 220 may be selected. Hereinafter, the nano water ion generating device 200 including the cooling portion 220 will be introduced.

The electrode fixing base 270 further includes a second boss portion 44 and an accommodating cavity 43A communicated to the first connecting hole 41. In a case where the nano water ion generating device 200 includes the cooling portion 220, the cooling portion 220 is located in the accommodating cavity 43A at the bottom of the electrode fixing base 270, and a portion of the cooling portion 220 abuts against the second boss portion 44. There is a gap (e.g., the water storage gap) between the transmission electrode 210 and the cooling portion 220.

The cooling portion 220 includes a ceramic insulating sheet 51, a PN junction 52, a metal conductor sheet 53, and a heat sink 54. The ceramic insulating sheet 51 is connected to a cold end of the PN junction 52, and therefore, the condensed water will be generated in the water storage gap between the transmission electrode 210 and the cooling portion 220.

In some embodiments, the ceramic insulating sheet 51 is located on a surface (e.g., an upper surface) of the PN junction 52 proximate to the first boss portion 43 to insulate the transmission electrode 210 from the PN junction 52, so as to avoid the negative high voltage transmitted to the transmission electrode 210 from affecting semiconductor cooling. A surface (e.g., a lower surface) of the PN junction 52 away from the first boss portion 43 is connected to the metal conductor sheet 53, and the metal conductor sheet 53 is connected to a power source to form an electrical circuit with the PN junction 52. The heat sink 54 is located at a side (e.g., the bottom) of the metal conductor sheet 53 away from the PN junction 52. The metal conductor sheet 53 may abut against the second boss portion 44.

Here, when current flows through the thermocouple formed by connecting the N-type semiconductor material and the P-type semiconductor material in the cooling portion 220, heat transfer will occur between the two ends of the PN junction 52, and the heat will be transferred from an end to another end of the PN junction 52, thereby generating a temperature difference to form a cold end and a hot end. In a case where the air is in contact with the cold end, the condensed water is produced.

The nano water ion generating device 200 in some embodiments of the present disclosure controls a distance between the transmission electrode 210 and the ceramic insulating sheet 51 by controlling a distance between the first boss portion 43 and the second boss portion 44 (e.g., a distance in a height direction of the transmission electrode 210), and there is a water storage gap in a range from 0.2 mm to 0.8 mm (e.g., 0.2 mm, 0.4 mm, 0.6 mm, or 0.8 mm) between the transmission electrode 210 and the ceramic insulating sheet 51. The ceramic insulating sheet 51 is located at a cooling surface on the upper surface of the PN junction 52. In a case where the condensed water 6 is generated on the cooling portion 220, the condensed water 6 is in contact with the transmission electrode 210 and is absorbed by the transmission electrode 210, thereby continuously providing moisture to the transmission electrode 210.

In the nano water ion generating device 200 in some embodiments of the present disclosure, the transmission electrode 210 may not only absorb moisture directly from the air, but also utilize the condensed water provided by the cooling portion 220, thereby fully ensuring the water supply of the transmission electrode 210, so that the nano water ion generating device 200 may stably generate the nano water ions with negative oxygen ions.

The electrode fixing base 270 includes a fourth vent communicated with the accommodation cavity 43A. The fourth vent may circulate the air between the cooling portion 220 and the electrode fixing base 270, so that the cooling portion 220 condenses water in the air.

In some embodiments of the nano water ion generating device 200 of the present disclosure, in an environment with high air humidity, the transmission electrode 210 directly absorbs moisture in the air to supply water to the transmission electrode 210. The transmission electrode 210 uses the surrounding ground or grounded objects as a counter electrode and directly ionizes water by using the negative high voltage, so as to generated the nano water ions containing the negative oxygen ions, thereby improving the air purification capability.

[Control System of Indoor Unit]

Figure 26:
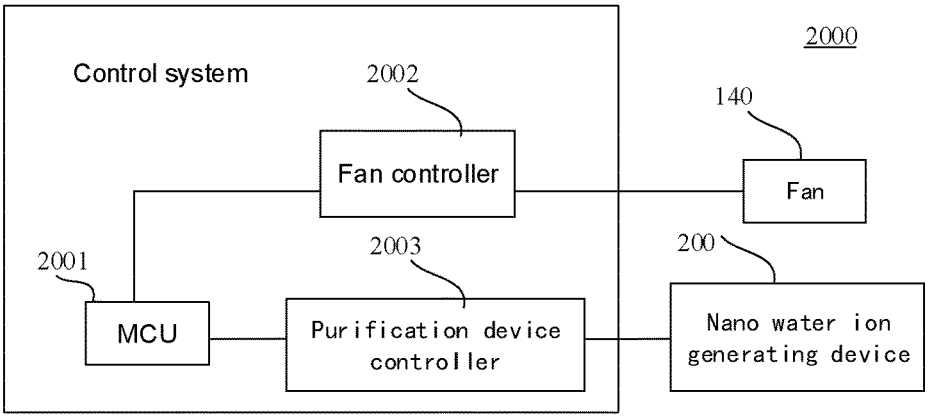
FIG. 26 is a block diagram of a control system of an indoor unit, in accordance with some embodiments.

Some embodiments of the present disclosure further provide a control system 2000 of the indoor unit. Referring to FIG. 26, the control system 2000 includes a microcontroller unit (MCU) 2001, a fan controller 2002, a fan 140, a purification device controller 2003, and a nano water ion generating device 200.

The MCU 2001 is disposed in the indoor controller of the indoor unit 10. The fan controller 2002 is further disposed in the indoor controller and is electrically connected to the MCU. The fan 140 is disposed in the first housing 100 (i.e., in the first accommodating space 101) of the indoor unit 10 and electrically connected to the fan controller 2002. The purification device controller 2003 is disposed on the indoor controller and is electrically connected to the MCU. The nano water ion generating device 200 is disposed at the air outlet 120 of the indoor unit 10 and is electrically connected to the purification device controller 2003.

It will be noted that the nano water ion generating device 200 may implement the release of the nano water ions and the negative oxygen ions simultaneously from a same transmission electrode 210.

By linking the nano water ion generating device 200 with the fan 140, the nano water ion generating device 200 is turned on later than the fan 140 for a first time t11, and the fan 140 is not turned on, and the nano water ion generating device 200 can not be turned on. Similarly, the nano water ion generating device 200 is turned off earlier than the fan 140 for a second time t12, and the fan 140 can be turned off only after the nano water ion generating device 200 is turned off, thereby preventing the negative ions generated by the nano water ion generating device 200 from accumulating in the first housing 100 to generate static electricity.

It will be noted that the first time t11 and the second time t12 may be equal or unequal.

[Control Method of Indoor Unit]

In some embodiments, the nano water ion generating device 200 is controlled by the indoor controller of the indoor unit 10 and is linked with the fan 140 of the indoor unit 10.

Figure 27:
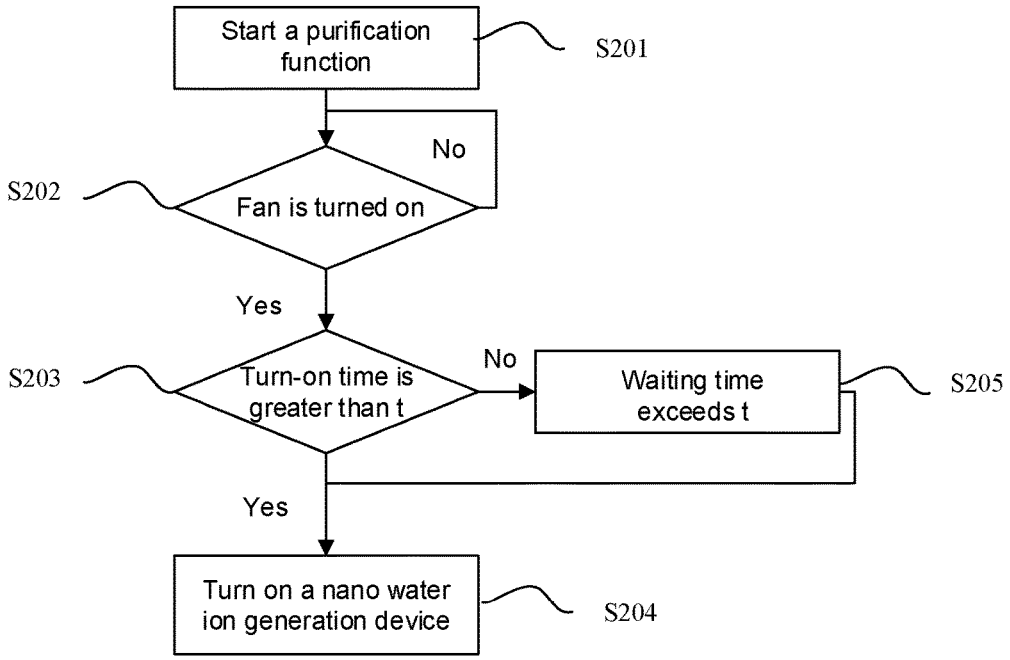
FIG. 27 is a flow chart of a control method of an indoor unit, in accordance with some embodiments.

Referring to FIG. 27, the control method of the control system of the indoor unit includes step S201 to step S205.

In step S201, a purification function is turned on.

In step S202, it is determined whether the fan 140 is turned on. If so, step S203 is performed. If not, step S202 is performed.

In step S203, in a case where the fan 140 is turned on, it is determined whether the turn-on time of the fan 140 is greater than a threshold (e.g., t) time. If so, step S204 is performed. If not, step S204 is performed after step S205.

In step S204, the nano water ion generating device 200 is turned on.

In step S205, after the waiting time exceeds the threshold time, S204 is performed.

For example, after the user chooses to turn on the purification function, the controller first determines whether the fan 140 is turned on, and determines the turn-on time of the fan 140. In a case where the first time that the fan 140 is turned on (i.e., operating) is greater than the first threshold (e.g., t11>5s), the nano water ion generating device 200 starts to be turned on. Otherwise, the nano water ion generating device 200 can not be turned on.

In a case where the user chooses to turn off the purification function, the nano water ion generating device 200 immediately cuts off power and keeps the fan 140 operating for the second time. In a case where the second time is greater than the second threshold (e.g., t12>5s), the fan 140 is controlled to be turned off. This prevents negative ions generated by the nano water ion generating device 200 from accumulating in the first housing 100 of the indoor unit 10 to generate static electricity, thereby causing adverse effects on the indoor unit 10.

It will be noted that the first time threshold and the second time threshold may be equal or unequal.

The foregoing descriptions are merely specific implementations of the present disclosure, but the protection scope of the present disclosure is not limited thereto. Changes or replacements that any person skilled in the art could conceive of within the technical scope of the present disclosure shall be included in the protection scope of the present disclosure. Therefore, the protection scope of the present disclosure shall be subject to the protection scope of the claims.

A person skilled in the art will understand that the scope of disclosure in the present disclosure is not limited to specific embodiments discussed above and may modify and substitute some elements of the embodiments without departing from the spirits of this application. The scope of this application is limited by the appended claims.

What is claimed is:

1. An air conditioner, comprising:

an outdoor unit; and an indoor unit connected to the outdoor unit and including:

a first housing including a first accommodating space, a return air inlet, and an air outlet; the return air inlet and the air outlet being communicated with the first accommodating space;

a fan disposed in the first accommodating space and opposite to the return air inlet;

an indoor heat exchanger disposed in the first accommodating space and located at a side of the fan proximate to the air outlet;

a piping box disposed in the first accommodating space and proximate to the air outlet;

a nano water ion generating device disposed in the first accommodating space and located at a position of the first housing proximate to the air outlet; the nano water ion generating device being configured to generate nano water ions with negative charges and hydroxyl radicals generated by ionized water; the nano water ion generating device including a nano water ion outlet; and the nano water ion generating device and the piping box being communicated through a vent therebetween; and a connecting plate disposed on a side wall of the first housing where the air outlet is disposed and configured to install the nano water ion generating device;

wherein air in the piping box enters the nano water ion generating device through the vent, and air with the nano water ions is sent indoors through the nano water ion outlet, so as to avoid influence of temperature and humidity changes in air at the air outlet on condensation ability of the nano water ion generating device; and the piping box includes a first vent, the nano water ion generating device includes a second vent, the connecting plate includes a third vent, and the air in the piping box enters the nano water ion generating device through the first vent, the third vent, and the second vent, wherein the vent includes at least the first vent and the second vent.

2. The air conditioner according to claim 1, wherein the indoor heat exchanger is installed obliquely in the first accommodating space and is configured to incline in a direction proximate to the air outlet; the nano water ion generating device is located at a side of the indoor heat exchanger proximate to the air outlet; and the nano water ion generating device includes a transmission electrode configured to absorb moisture from the air.

3. The air conditioner according to claim 2, wherein the transmission electrode is disposed perpendicular to a plane where the indoor heat exchanger is located.

4. The air conditioner according to claim 2, wherein the transmission electrode is disposed perpendicular to a plane where the air outlet is located; or, the transmission electrode is disposed parallel to the plane where the air outlet is located.

5. The air conditioner according to claim 1, wherein the nano water ion generating device further includes:

a second housing including a second accommodating space; the second vent being disposed at a side of the second housing proximate to the piping box; the nano water ion outlet being disposed at a side of the second housing away from the indoor heat exchanger; and air in the nano water ion generating device entering indoors through the nano water ion outlet;

a fixed installation member disposed on the second housing and connected to the connecting plate, so as to achieve a fixation of the nano water ion generating device; and a transmission electrode, and at least a portion of the transmission electrode being located in the nano water ion outlet.

6. The air conditioner according to claim 5, wherein the connecting plate includes:

a body, the third vent extending through the body in a thickness direction;

a first fixing portion disposed around the body and connected to the second housing; and a second fixing portion disposed proximate to the third vent and connected to the fixed installation member.

7. The air conditioner according to claim 6, wherein the second fixing portion includes a fixing hole, the fixing hole and the third vent jointly forming an installation opening; the nano water ion generating device is installed at the installation opening; and a portion of the nano water ion generating device is located inside the piping box.

8. A control system of the air conditioner according to claim 1, wherein the indoor unit of the air conditioner further includes an indoor controller; the control system comprises:

a microcontroller disposed on the indoor controller;

a fan controller disposed on the indoor controller and electrically connected to the micro controller, the fan being electrically connected to the fan controller;

a purification device controller disposed on the indoor controller and electrically connected to the microcontroller; and the nano water ion generating device being disposed at the air outlet of the indoor unit and electrically connected to the purification device controller;

wherein the nano water ion generating device is controlled by the indoor controller of the indoor unit and is linked with the fan of the indoor unit.

9. A control method of the air conditioner according to claim 1, wherein the air conditioner has a purification function; the method comprises:

in a case where the purification function is turned on, determining whether the fan is turned on and determining a turn-on time;

in a case where a first time that the fan is turned on is greater than a first threshold, the nano water ion generating device is turned on, otherwise the nano water ion generating device is not capable of being turned on; and in a case where the purification function is turned off, the nano water ion generating device immediately cuts off power and keeps the fan operating for a second time; and in a case where the second time is greater than a second threshold, the fan is controlled to be turned off.

10. An air conditioner comprising:

an outdoor unit; and an indoor unit connected to the outdoor unit and including:

a first housing including a first accommodating space, a return air inlet, and an air outlet; the return air inlet and the air outlet being communicated with the first accommodating space;

a fan disposed in the first accommodating space and opposite to the return air inlet;

an indoor heat exchanger disposed in the first accommodating space and located at a side of the fan proximate to the air outlet;

a piping box disposed in the first accommodating space and proximate to the air outlet; and a nano water ion generating device disposed in the first accommodating space and located at a position of the first housing proximate to the air outlet; the nano water ion generating device being configured to generate nano water ions with negative charges and hydroxyl radicals generated by ionized water; the nano water ion generating device including a nano water ion outlet; and the nano water ion generating device and the piping box being communicated through a vent therebetween;

wherein air in the piping box enters the nano water ion generating device through the vent, and air with the nano water ions is sent indoors through the nano water ion outlet, so as to avoid influence of temperature and humidity changes in air at the air outlet on condensation ability of the nano water ion generating device;

the nano water ion generating device is disposed at the air outlet;

the return air inlet and the air outlet are connected to form an air duct; the indoor heat exchanger is disposed in the air duct; the air duct includes a first air duct and a second air duct that are communicated with each other; and the first air duct is further away from the air outlet than the second air duct;

the nano water ion generating device further includes a transmission electrode and a cooling portion, and the cooling portion is configured to generate condensed water for ionization by the transmission electrode; and a portion of air in the first air duct flows to the nano water ion generating device through the piping box;

wherein the air conditioner further comprises an air pretreatment device disposed in an air flow path between the piping box and the nano water ion generating device; and the air pretreatment device is configured to preheat or precool air, so as to improve a temperature difference of surrounding air in the cooling portion.

11. The air conditioner according to claim 10, wherein the piping box includes a first vent; the nano water ion generating device includes a second housing, and the second housing includes a second accommodating space; the transmission electrode and the cooling portion are disposed in the second accommodating space; and the second housing includes a second vent and a nano water ion outlet for exposing a transmission tip of the transmission electrode;

wherein the portion of the air flowing into the first accommodating space from the return air inlet does not pass through the indoor heat exchanger for heat exchange, but directly flows into the second accommodating space through an inner cavity of the piping box, the first vent, and the second vent, and then flows out through the nano water ion outlet.

12. The air conditioner according to claim 11, wherein the air pretreatment device satisfies one of the following:

the air pretreatment device being disposed in the piping box; or, the air pretreatment device being disposed in the second accommodating space of the nano water ion generating device.

13. The air conditioner according to claim 11, wherein the air pretreatment device includes:

a first heat exchange plate located in the air flow path between the piping box and the cooling portion;

a second heat exchange plate located outside the air flow path between the piping box and the cooling portion; and a cooling sheet, a side of the cooling sheet being provided with the first heat exchange plate, and another side of the cooling sheet being provided with the second heat exchange plate.

14. The air conditioner according to claim 13, further comprising a connecting plate and a mounting portion; the connecting plate including a third vent, the mounting portion being inserted into in the third vent, and the mounting portion being disposed at a position where the piping box is communicated with the second vent; and the mounting portion communicating the piping box with the second accommodating space;

wherein the cooling sheet is disposed on a portion of the installation portion located in the piping box, the first heat exchange plate is located in an inner cavity of the installation portion, and the second heat exchange plate is located outside the installation portion.

15. The air conditioner according to claim 13, wherein the cooling sheet is disposed on the second housing, the first heat exchange plate is located in the second accommodating space, and the second heat exchange plate is located outside the second accommodating space.

16. The air conditioner according to claim 15, wherein the indoor unit includes a first partition plate configured to separate the first accommodating space into a first sub-space and a second sub-space; the indoor heat exchanger is located in the first sub-space; and the fan is located in the second sub-space;

the nano water ion generating device further includes a second partition plate, the second partition plate is disposed in the second accommodating space, and the second partition plate is configured to separate the second accommodating space into a third sub-space and a fourth sub-space; the second partition plate includes an opening for gas flow; the transmission electrode and the cooling portion are disposed in the third sub-space; and the first heat exchange plate is located in the fourth sub-space; and the nano water ion generating device further includes a power supply portion; the power supply portion is disposed in the fourth sub-space, coupled to the transmission electrode, and configured to provide negative high voltage to the transmission electrode, so as to ionize water absorbed by the transmission electrode into nano water ions with negative ions.

17. The air conditioner according to claim 13, wherein the air pretreatment device includes a first ventilation gap and a plurality of first heat exchange plates disposed at intervals, and the first ventilation gap is formed between two adjacent first heat exchange plates;

the air pretreatment device includes a second ventilation gap and a plurality of second heat exchange plates disposed at intervals, and the second ventilation gap is formed between two adjacent second heat exchange plates.

18. The air conditioner according to claim 10, wherein a position of a side of the piping box away from the air outlet facing towards the air duct is formed with an air inlet, so that the portion of the air in the first air duct flows to the piping box through the air inlet; and the air conditioner further includes a connecting plate; the connecting plate is disposed at a side of the indoor heat exchanger proximate to the air outlet; the first housing includes an inner bottom wall and a front side wall, and the front side wall is a side wall of the first housing provided with the air outlet; the connecting plate is connected to the inner bottom wall and the front side wall, so as to separate the piping box and the second air outlet; the nano water ion generating device is disposed on the connecting plate; and the connecting plate includes a third vent to guide air in the piping box to the nano water ion generating device.

19. The air conditioner according to claim 10, wherein the nano water ion generating device further includes a water storage gap formed between an end of the transmission electrode and the cooling portion; the transmission electrode is hydrophilic, the condensed water generated by the cooling portion is stored in the water storage gap; and the transmission electrode guides the condensed water in the water storage gap to a transmission tip of the transmission electrode.

* * * * *